US007294238B2

(12) United States Patent
Bakken et al.

(10) Patent No.: US 7,294,238 B2
(45) Date of Patent: Nov. 13, 2007

(54) NON-WOVEN THROUGH AIR DRYER AND TRANSFER FABRICS FOR TISSUE MAKING

(75) Inventors: Andrew Peter Bakken, Appleton, WI (US); Mark Alan Burazin, Oshkosh, WI (US); Jeffrey Dean Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 260 days.

(21) Appl. No.: 11/051,340

(22) Filed: Feb. 4, 2005

(65) Prior Publication Data

US 2006/0081349 A1 Apr. 20, 2006

Related U.S. Application Data

(62) Division of application No. 10/325,565, filed on Dec. 19, 2002, now Pat. No. 6,878,238.

(51) Int. Cl.
*D21F 7/10* (2006.01)
*D21F 1/10* (2006.01)

(52) U.S. Cl. ..... 162/362; 162/116; 162/117; 162/306; 162/348; 162/358.2; 162/900; 162/903; 162/904; 264/280; 264/284; 264/563; 264/571

(58) Field of Classification Search ..... 162/109–117, 162/204–207, 900–904, 306, 348, 358.2, 162/358.4, 361, 362; 428/33, 58–67, 212–220, 428/156–165, 192–193; 28/110, 142; 139/383 A, 139/425 A; 264/448, 555, 280, 284, 563–571
See application file for complete search history.

(56) References Cited

U.S. PATENT DOCUMENTS 3,034,180 A 5/1962 Greiner et al.
3,338,992 A 8/1967 Kinney
3,341,394 A 9/1967 Kinney
3,423,266 A 1/1969 Davies et al.
3,485,706 A 12/1969 Evans (Continued)

FOREIGN PATENT DOCUMENTS

EP 0 394 134 A1 10/1990

(Continued)

OTHER PUBLICATIONS

Bieman, Dr. Leonard H., Kevin G. Harding, and Alber Boehnlein, "Absolute Measurement Using Field Shifted Moiré," Proceedings of *Optics, Illumination, and Image Sensing for Machine Vision VI*, SPIE vol. 1614, Nov. 1991, pp. 259-264.

(Continued)

*Primary Examiner*—Eric Hug
(74) *Attorney, Agent, or Firm*—Gregory E. Croft

(57) ABSTRACT

One embodiment of the present invention is an endless non-woven tissue making fabric having a three-dimensional texture suitable for use as a fabric for producing three-dimensional fibrous webs. The endless non-woven tissue making fabric comprises a plurality of substantially parallel adjoining sections of non-woven material. Each section of non-woven material has a width substantially less than the width of the non-woven tissue making fabric. Each section of non-woven material may be joined to at least one other adjoining section of non-woven material. The non-woven tissue making fabric has a machine direction, a cross-machine direction, a tissue contacting surface and a tissue machine contacting surface. The tissue contacting surface comprises solid matter at a plurality of heights such that the tissue contacting surface of the non-woven tissue making fabric has an Overall Surface Depth of at least 0.2 mm in regions of solid matter on the tissue contacting surface.

33 Claims, 19 Drawing Sheets

U.S. PATENT DOCUMENTS

| | | | | |
|---|---|---|---|---|
| 3,494,821 | A | 2/1970 | Evans | |
| 3,502,538 | A | 3/1970 | Petersen | |
| 3,502,763 | A | 3/1970 | Hartmann | |
| 3,542,615 | A | 11/1970 | Dobo et al. | |
| 3,556,932 | A | 1/1971 | Coscia et al. | |
| 3,556,933 | A | 1/1971 | Williams et al. | |
| 3,585,104 | A | 6/1971 | Kleinert | |
| 3,595,245 | A | 7/1971 | Buntin et al. | |
| 3,595,731 | A | 7/1971 | Davies et al. | |
| 3,597,299 | A | 8/1971 | Thomas et al. | |
| 3,652,389 | A | 3/1972 | Helland | |
| 3,676,242 | A | 7/1972 | Prentice | |
| 3,692,618 | A | 9/1972 | Dorschner et al. | |
| 3,704,198 | A | 11/1972 | Prentice | |
| 3,715,251 | A | 2/1973 | Prentice | |
| 3,729,785 | A | 5/1973 | Sommer | |
| 3,879,257 | A | 4/1975 | Gentile et al. | |
| 3,881,987 | A | 5/1975 | Benz | |
| 3,890,681 | A | 6/1975 | Fekete et al. | |
| 3,993,532 | A | 11/1976 | Mcdonald et al. | |
| 4,041,203 | A | 8/1977 | Brock et al. | |
| 4,068,036 | A | 1/1978 | Stanistreet | |
| 4,314,001 | A | 2/1982 | Wesseler | |
| RE30,955 | E | 6/1982 | Stanistreet | |
| 4,340,563 | A | 7/1982 | Appel et al. | |
| 4,363,684 | A | 12/1982 | Hay, II | |
| 4,374,888 | A | 2/1983 | Bornslaeger | |
| 4,440,597 | A | 4/1984 | Wells et al. | |
| 4,514,345 | A | 4/1985 | Johnson et al. | |
| 4,522,863 | A | 6/1985 | Keck et al. | |
| 4,528,239 | A | 7/1985 | Trokhan | |
| 4,529,480 | A | 7/1985 | Trokhan | |
| 4,541,895 | A * | 9/1985 | Albert | 162/348 |
| 4,551,199 | A | 11/1985 | Weldon | |
| 4,659,614 | A | 4/1987 | Vitale | |
| 4,731,276 | A | 3/1988 | Manning et al. | |
| 4,737,393 | A | 4/1988 | Linkous | |
| 4,740,409 | A * | 4/1988 | Lefkowitz | 428/131 |
| 4,766,029 | A | 8/1988 | Brock et al. | |
| 4,808,467 | A | 2/1989 | Suskind et al. | |
| 4,842,905 | A * | 6/1989 | Stech | 428/33 |
| 4,849,054 | A | 7/1989 | Klowak | |
| 4,886,632 | A | 12/1989 | Van Iten et al. | |
| 4,919,877 | A | 4/1990 | Parsons et al. | |
| 4,926,533 | A | 5/1990 | Couture | |
| 4,962,576 | A | 10/1990 | Minichshofer et al. | |
| 5,038,775 | A | 8/1991 | Maruscak et al. | |
| 5,069,548 | A | 12/1991 | Boehnlein | |
| 5,096,532 | A | 3/1992 | Neuwirth et al. | |
| 5,098,522 | A | 3/1992 | Smurkoski et al. | |
| 5,139,841 | A | 8/1992 | Makoui et al. | |
| 5,167,771 | A | 12/1992 | Sayers et al. | |
| 5,169,706 | A | 12/1992 | Collier, IV et al. | |
| 5,178,729 | A | 1/1993 | Janda | |
| 5,227,242 | A | 7/1993 | Walter et al. | |
| 5,260,171 | A | 11/1993 | Smurkoski et al. | |
| 5,268,076 | A | 12/1993 | Best et al. | |
| 5,275,700 | A | 1/1994 | Trokhan | |
| 5,328,565 | A | 7/1994 | Rasch et al. | |
| 5,334,289 | A | 8/1994 | Trokhan et al. | |
| 5,336,552 | A | 8/1994 | Strack et al. | |
| 5,353,521 | A | 10/1994 | Orloff | |
| 5,360,656 | A | 11/1994 | Rexfelt et al. | |
| 5,431,786 | A | 7/1995 | Rasch et al. | |
| 5,464,688 | A | 11/1995 | Timmons et al. | |
| 5,496,624 | A | 3/1996 | Stelljes, Jr. et al. | |
| 5,500,277 | A | 3/1996 | Trokhan et al. | |
| 5,503,715 | A | 4/1996 | Trokhan et al. | |
| 5,511,294 | A | 4/1996 | Fehrer | |
| 5,512,319 | A | 4/1996 | Cook et al. | |
| 5,514,523 | A | 5/1996 | Trokhan et al. | |
| 5,554,467 | A | 9/1996 | Trokhan et al. | |
| 5,566,724 | A | 10/1996 | Trokhan et al. | |
| 5,573,637 | A | 11/1996 | Ampulski et al. | |
| 5,598,642 | A | 2/1997 | Orloff et al. | |
| 5,598,843 | A | 2/1997 | Caisey et al. | |
| 5,607,980 | A | 3/1997 | McAtee et al. | |
| 5,614,293 | A | 3/1997 | Krzysik et al. | |
| 5,624,790 | A | 4/1997 | Trokhan et al. | |
| 5,628,876 | A | 5/1997 | Ayers et al. | |
| 5,643,588 | A | 7/1997 | Roe et al. | |
| 5,643,653 | A | 7/1997 | Griesbach, III et al. | |
| 5,650,218 | A | 7/1997 | Krzysik et al. | |
| 5,656,132 | A | 8/1997 | Farrington, Jr. et al. | |
| 5,667,636 | A | 9/1997 | Engel et al. | |
| 5,699,626 | A | 12/1997 | Chuang et al. | |
| 5,701,682 | A | 12/1997 | Chuang et al. | |
| 5,707,468 | A * | 1/1998 | Arnold et al. | 156/62.6 |
| 5,713,399 | A | 2/1998 | Collette et al. | |
| 5,716,692 | A | 2/1998 | Warner et al. | |
| 5,817,377 | A | 10/1998 | Trokhan et al. | |
| 5,827,384 | A | 10/1998 | Canfield et al. | |
| 5,830,321 | A | 11/1998 | Lindsay et al. | |
| 5,855,739 | A | 1/1999 | Ampulski et al. | |
| 5,871,613 | A | 2/1999 | Bost et al. | |
| 5,871,763 | A | 2/1999 | Luu et al. | |
| 5,882,573 | A | 3/1999 | Kwok et al. | |
| 5,885,416 | A | 3/1999 | Marinack et al. | |
| 5,885,418 | A | 3/1999 | Anderson et al. | |
| 5,893,965 | A | 4/1999 | Trokhan et al. | |
| 5,897,745 | A | 4/1999 | Ampulski et al. | |
| 5,904,298 | A | 5/1999 | Kwok et al. | |
| 5,932,291 | A | 8/1999 | Sayers et al. | |
| 5,935,381 | A | 8/1999 | Trokhan et al. | |
| 5,962,112 | A * | 10/1999 | Haynes et al. | 428/198 |
| 5,972,813 | A | 10/1999 | Polat et al. | |
| 5,986,167 | A | 11/1999 | Arteman et al. | |
| 5,990,377 | A | 11/1999 | Chen et al. | |
| 6,001,300 | A | 12/1999 | Buckley | |
| 6,010,598 | A | 1/2000 | Boutilier et al. | |
| 6,017,417 | A | 1/2000 | Wendt et al. | |
| 6,071,837 | A * | 6/2000 | Crook | 442/268 |
| 6,080,691 | A | 6/2000 | Lindsay et al. | |
| 6,096,169 | A | 8/2000 | Hermans et al. | |
| 6,103,060 | A | 8/2000 | Munerelle et al. | |
| 6,120,642 | A | 9/2000 | Lindsay et al. | |
| 6,124,015 | A | 9/2000 | Baker et al. | |
| 6,143,135 | A | 11/2000 | Hada et al. | |
| 6,149,768 | A | 11/2000 | Hepford | |
| 6,162,518 | A | 12/2000 | Korfer | |
| 6,171,442 | B1 | 1/2001 | Farrington, Jr. et al. | |
| 6,197,154 | B1 | 3/2001 | Chen et al. | |
| 6,200,669 | B1 | 3/2001 | Marmon et al. | |
| 6,240,608 | B1 | 6/2001 | Paquin et al. | |
| 6,398,910 | B1 | 6/2002 | Burazin et al. | |
| 6,420,100 | B1 | 7/2002 | Trokhan et al. | |
| 6,461,474 | B1 | 10/2002 | Lindsay et al. | |
| 6,554,963 | B1 * | 4/2003 | Botelho et al. | 162/289 |
| 6,565,713 | B2 | 5/2003 | Hansen et al. | |
| 6,569,290 | B2 | 5/2003 | Johnson | |
| 6,592,714 | B2 | 7/2003 | Lamb | |
| 6,617,490 | B1 * | 9/2003 | Chen et al. | 604/380 |
| 6,699,366 | B2 | 3/2004 | Paquin et al. | |
| 6,702,927 | B2 | 3/2004 | Moriarty et al. | |
| 6,723,208 | B1 | 4/2004 | Hansen | |
| 6,726,809 | B2 * | 4/2004 | Joyce et al. | 162/358.1 |
| 6,875,315 | B2 | 4/2005 | Bakken et al. | |
| 6,878,238 | B2 | 4/2005 | Bakken et al. | |
| 2002/0055310 | A1 | 5/2002 | Falk et al. | |
| 2002/0104631 | A1 | 8/2002 | Hansen et al. | |
| 2003/0102098 | A1 | 6/2003 | Allen et al. | |

2005/0067125 A1 3/2005 Burazin et al.

FOREIGN PATENT DOCUMENTS

| | | | |
|---|---|---|---|
| EP | 0 741 815 | A1 | 11/1996 |
| EP | 0 653 512 | B1 | 2/1998 |
| EP | 0 999 306 | A2 | 5/2000 |
| EP | 1 045 066 | A2 | 10/2000 |
| EP | 1 063 349 | A2 | 12/2000 |
| EP | 1 167 817 | A2 | 11/2001 |
| GB | 1008703 | A | 11/1965 |
| GB | 1 217 892 | A | 12/1970 |
| GB | 2 202 873 | A | 10/1988 |
| GB | 2 254 287 | A | 10/1992 |
| JP | 2003-227086 | A | 8/2003 |
| JP | 2003-239190 | A | 8/2003 |
| JP | 2003-239191 | A | 8/2003 |
| JP | 2003-239192 | A | 8/2003 |
| WO | WO 95/18157 | A1 | 7/1995 |
| WO | WO 95/21285 | A1 | 8/1995 |
| WO | WO 98/01618 | A1 | 1/1998 |
| WO | WO 98/27277 | * | 6/1998 |
| WO | WO 98/27277 | A1 | 6/1998 |
| WO | WO 98/53138 | A1 | 11/1998 |
| WO | WO 99/09247 | A1 | 2/1999 |
| WO | WO 01/26595 | A1 | 4/2001 |
| WO | WO 02/29157 | A1 | 4/2002 |
| WO | WO 02/41815 | A2 | 5/2002 |

OTHER PUBLICATIONS

Courtney, Patrick J. and Christine M. Salerni, "Shedding New Light on Adhesives," *Adhesives Age*, vol. 44, No. 2, Feb. 2001, pp. 38,40-41, 49.

Lindsay, Jeffrey D., "Displacement Dewatering To Maintain Bulk," *Paperi Ja Puu—Paper And Timber*, vol. 74, No. 3, 1992, pp. 232-242.

Malkan, Sanjiv R. and Larry C. Wadsworth, "Process-Structure-Property Relationships In Melt Blowing Of Different Molecular Weight Polypropylene Resins, Part 1—Physical Properties," *INDA Journal of Nonwovens Research*, vol. 3, No. 2, Spring 1991, pp. 21-34.

Mummery, Leigh, *Surface Texture Analysis: The Handbook*, published by Hommelwereke GmbH, Muhlhausen, Germany, 1990, pp. 28-29, 34-37.

Wente, V.A. et al., "Manufacture of Superfine Organic Fibers," *NRL Report 4364*, U.S. Naval Research Laboratory, Washington, D.C., May 25, 1954, pp. 1-15.

Wente, Van A., "Superfine Thermoplastic Fibers," *Industrial and Engineering Chemistry*, vol. 48, No. 8, Aug. 1956, pp. 1342-1346.

* cited by examiner

NON-WOVEN THROUGH AIR DRYER AND TRANSFER FABRICS FOR TISSUE MAKING

This application is a divisional of application Ser. No. 10/325,565, now U.S. Pat. No. 6,878,238, filed on Dec. 19, 2002. The entirety of application Ser. No. 10/325,565 is hereby incorporated by reference.

BACKGROUND

Fabrics used as through air drying and transfer fabrics in a tissue making process are typically woven endless fabrics manufactured using a tubular weaving technique or seaming a flat woven fabric into an endless structure. In either method of manufacturing, the weaving process is an expensive, complex, labor-intensive process. Developing new weaving patterns and materials that deliver the desired characteristics of the fabric and the tissue product can require a large investment of time and money. Additionally, there are physical constraints on the patterns and height differentials that may be woven on a loom, and there are further constraints on the runnability of fabrics so manufactured.

The use of substrates other than woven fabrics in the formation or drying of paper is known to a limited degree, such as non-fibrous monoplanar films and membranes used in the production of tissue. In tissue making, these structures typically offer flat, planar, non-fibrous regions for imprinting a web during a compression step in order to provide a network of densified regions surrounding undensified regions, with the densified regions providing strength and the undensified regions providing softness and absorbency. Such structures and processes lack the contoured, non-planar three-dimensionality that may be useful in producing textured and noncompressively dried materials and lack the intrinsic porosity and other properties found in fibrous materials. Such processes also result in a sheet with regions of high density and regions of low density, which is not suitable for some products. Further, substantially planar films are inherently limited in their ability to impart three-dimensional structures to a sheet.

Therefore, there is a need for improved tissue making fabrics capable of overcoming one or more of the limitations of previously known materials.

SUMMARY

The present invention is a non-woven tissue making fabric comprising a plurality of substantially parallel adjoining sections of non-woven material having a width less than the width of the non-woven tissue making fabric, the sections being joined together to form a non-woven tissue making fabric of sufficient strength and permeability to be suitable for use as a through-drying fabric, a forming fabric, an imprinting fabric, a transfer fabric, a carrier fabric, an impulse drying fabric, a pressing fabric or press felt, a drying fabric, a capillary dewatering belt, or other fabrics of use in tissue making or in the manufacture of other bulky fibrous webs such as airlaid webs, coform, nonwoven webs, and the like (such uses are encompassed in the general term "non-woven tissue making fabric," unless otherwise specified). The plurality of sections of nonwoven material may comprise a single fabric strip that is repeatedly wrapped in a substantially spiral manner to form parallel adjacent sections that can abut one another or overlap one another in successive turns to form a continuous loop of non-woven tissue making fabric having a width substantially greater than the width of the fabric strip of non-woven material. When a single fabric strip wrapped in a spiral manner is bonded to itself in regions of overlap for adjacent sections of the strip, the non-woven tissue making fabric is said to have a spirally continuous seam. In such a non-woven tissue making fabric, wherein each fabric strip of non-woven material has a first edge and an opposing second edge, the fabric strip of non-woven material is spirally wound in a plurality of contiguous turns such that the first edge in a turn of the fabric strip extends beyond the second edge of an adjacent turn of the fabric strip, forming a spirally continuous seam with adjacent turns of the fabric strip. In another embodiment, the first edge of the fabric strip in a turn may abut the second edge of the fabric strip in an adjacent turn.

A seam formed between the adjacent sides of parallel fabric strips or adjacent sections of a single spirally wound fabric strip may represent a region with higher basis weight or thickness when the non-woven materials of the adjacent fabric strips overlap. However, non-woven fabric strips may be used that have a tapered basis weight profile or thickness profile in the cross-direction, with lower basis weight or thickness at or adjacent the first and/or second opposing edges. In this manner, two overlapping adjacent edges of adjacent fabric strips may result in a more uniform non-woven tissue making fabric because the region of overlap may have a less pronounced increase in thickness or basis weight, and may even yield a substantially uniform thickness or basis weight profile in the cross-direction of the non-woven tissue making fabric when the profiles of the individual fabric strips are suitably tailored.

In another embodiment, the plurality of sections of non-woven material may comprise a plurality of fabric strips that abut or overlap adjacent fabric strips. Seams may be formed by bonding adjacent fabric strips in regions of overlap or in regions where adjacent, non-overlapping fabric strips abut about their first and second opposing end edges, yielding a non-woven tissue making fabric that is said to have discontinuous seams. In yet another embodiment, the non-woven tissue making fabric may have regions where fabric strips abut one another and regions where the fabric strips overlap. For example, lower layers of fabric strips may overlap to provide good bond strength, while one or more upper layers of fabric strips may abut to provide a more uniform surface.

In still another embodiment, the non-woven tissue making fabric comprises a single fabric strip having at least one section substantially as wide as the non-woven tissue making fabric itself, and further comprising at least one other section having a width less than the non-woven tissue making fabric. Such a non-woven tissue making fabric may be made by spiral winding a fabric strip of non-woven material of a first width to form a multiply spiral wound structure, and then trimming the structure to a second width less than the first width. (Typically, this would be done in the machine direction.) In this case, some sections of the trimmed structure may have a width substantially less than the width of the non-woven tissue making fabric.

In another embodiment, the non-woven tissue making fabric comprises a least one fabric strip of non-woven material wound upon itself to form at least one region in the non-woven tissue making fabric having two superimposed plies of the non-woven material bonded together, one above the other. Such a non-woven tissue making fabric may have a substantially heterogeneous basis weight distribution, with high basis weight regions coinciding with regions of self-overlap of the wound fabric strip of non-woven material, where two or more plies are superimposed. Such a nonwoven tissue making fabric may be bonded together such that a nonlinear (discontinuous) seam region exists for improved fabric strength.

A single non-woven tissue making fabric may comprise more than one type of seam. For example, a spirally wound non-woven fabric strip may be joined with a plurality of non-spirally wound non-woven fabric strips, either in a plurality of separately formed layers or in more complex structures in which various fabric strips pass over or under each other.

The present invention is also a method of making a non-woven tissue making fabric. In one embodiment, a fabric strip of non-woven material having a first edge and an opposing second edge is provided. The fabric strip is spirally wound in a plurality of turns such that the first edge in a turn of the fabric strip extends beyond the second edge of an adjacent turn of the fabric strip. A spirally continuous seam is formed with adjacent turns of the fabric strip. In another embodiment, the first edge of the fabric strip in a turn may abut the second edge of the fabric strip in an adjacent turn.

In another embodiment, a plurality of fabric strips of one or more non-woven fabrics are aligned to be substantially parallel with each other but offset such that adjacent fabric strips either abut (adjoin without an overlapping rejoin) or overlap but not completely, and the adjoining strips are then bonded together to form a non-woven tissue making fabric. For embodiments of a non-woven tissue making fabric having a substantially three-dimensional tissue contacting surface (generally understood to be the web-contacting surface), the non-woven fabric strip may have been previously treated to have a three-dimensional surface structure, or the non-woven tissue making fabric may have been further treated to impart increased three-dimensional texture.

In another embodiment, a fabric strip of non-woven material is folded upon itself in a flattened helical pattern and bonded to form a non-woven tissue making fabric such that a tissue contacting surface of the non-woven tissue making fabric comprises substantially parallel abutting and/or overlapping sections of the non-woven material aligned with an axis at a first angle, and the inner layer (in some embodiments, the tissue machine contacting surface of the non-woven tissue making fabric opposite the tissue contacting surface of the non-woven tissue making fabric) comprises substantially parallel abutting or overlapping sections of the non-woven material aligned with an axis at a second angle, the first axis being a mirror image of the second axis reflected about the machine direction axis of the non-woven tissue making fabric.

In forming the non-woven tissue making fabrics of the present invention, a hierarchy of components may be defined employing the terms "ply," "layer," and "stratum." The non-woven tissue making fabric may comprise one or more distinct non-woven plies substantially as wide as the non-woven tissue making fabric itself, including at least one ply comprising a plurality of sections of non-woven material bonded together wherein neighboring sections abut or overlap to form one or more layers (e.g., when two neighboring sections overlap, the region of overlap has two layers; whereas abutting, non-overlapping parallel sections of non-woven fabric would form a single layer). In turn, each section or layer of non-woven material may itself comprise a plurality of joined-together strata (e.g., a unitary web formed by laying meltblown fibers onto a spunbond web would have two strata within the unitary web). In some embodiments, "section" and "strip" may be synonymous, while in some other embodiments hereafter described, a single fabric strip may form multiple sections, or a section may comprise multiple fabric strips joined together. A single fabric strip may also comprise multiple strata, which need not be completely coextensive, such that the edges of one stratum are not directly aligned with the edges of the adjacent stratum. The width of a ply, layer, stratum, strip, and/or section may have a width of less than the finished non-woven tissue making fabric, about the same width of the finished non-woven tissue making fabric, or have a width greater than the finished non-woven tissue making fabric.

The term "web" may refer to a ply, layer, or stratum in the above-mentioned hierarchy, depending on the context.

In some embodiments, a fabric strip of non-woven material may be spiral wound to form a section of non-woven material having a first width and regions having two layers of the fabric strips of non-woven material. The section may then be further spiral wound to form a ply having a second width greater than the first width. The resulting ply may then be joined to other non-woven plies or reinforcement plies to form a non-woven fabric strip, or the ply may be used as a non-woven tissue making fabric per se, and further provided with additional treatments as needed (e.g., edge reinforcement, perforations, three-dimensional molding, chemical finishing, foam bonding, point bonding, heat treatments, curing of adhesive components, electron beam treatments, corona discharge treatment, generation of electrets, needling, hydroneedling, hydroentangling, or treatment with surfactants, web lubricants, silicone agents, etc.).

Joining any of these elements—plies, layers, or strata—to one another may be accomplished by any means known in the art. In addition to thermal bonding and its known variants involving the application of heat and pressure (e.g., point bonding, etc.), many other known methods may be used to join two materials together (e.g., joining superposed portions of two fabric strips in a region where one fabric strip abuts an adjacent fabric strip) or for joining one material to an underlying material. For example, hydroentangling or hydroneedling with jets of water may entangle fibers in one material with those of an adjoining material to attach the material. Illustrative methods are disclosed in U.S. Pat. No. 3,485,706, issued to Evans in 1969; U.S. Pat. No. 3,494,821, issued to Evans in 1970; U.S. Pat. No. 4,808,467, issued on Feb. 28, 1989 to Suskind et al.; and, U.S. Pat. No. 6,200,669, issued on Mar. 13, 2001 to Marmon et al., all of which are herein incorporated by reference to the extent that they are non-contradictory herewith.

Coaperturing of two superposed webs of material (e.g., sections of non-woven material) may also be done, particularly coaperturing with heated pins that induce a degree of fusion of thermoplastic material in the webs of material in the vicinity of the aperture. Exemplary methods for coaperturing and equipment therefor are disclosed in U.S. Pat. No. 5,986,167, issued on Nov. 16, 1999 to Arteman et al. and U.S. Pat. No. 4,886,632, issued on Dec. 12, 1989 to Van Iten et al., both of which are herein incorporated by reference to the extent that they are non-contradictory herewith. Related methods also include perf-embossing, crimping of two or more webs of material, and embossing in general.

Joining these elements may also be achieved by the application of adhesive between the webs of material, such as a hot melt adhesive or adhesive meltblown, or binder material such as binder fibers added between adjoining webs of material followed by sufficient heating to fuse the binder material and join the webs of material, or other adhesives known in the art. Equipment and methods for adhesively joining two webs of material are taught in U.S. Pat. No. 5,871,613, issued on Feb. 16, 1999 to Bost et al.; U.S. Pat.

No. 5,882,573, issued on Mar. 16, 1999 to Kwok et al.; and, U.S. Pat. No. 5,904,298, issued on May 18, 1999 to Kwok et al., all of which are herein incorporated by reference to the extent that they are non-contradictory herewith. Hot melt or thermosetting adhesive applied by spray nozzles (including meltblowing methods) may be applied with such technologies. Photocurable adhesives may also be used, such as photocuring cyanoacrylates and acrylics described by P. J. Courtney, "Shedding New Light on Adhesives," Adhesives Age, February 2001, or the photocuring systems described in commonly owned U.S. patent application Ser. No. 09/705,684, "Improved Deflection Members for Tissue Production," filed on Nov. 3, 2000 by Lindsay et al., herein incorporated by reference to the extent that it is non-contradictory herewith.

Ultrasonic welding may be applied to join webs of material using rotary horns, ultrasonically activated pressing plates, or other devices. Equipment and methods useful for ultrasonic welding of nonwoven webs are disclosed in U.S. Pat. No. 3,993,532, issued on Nov. 23, 1976 to McDonald et al.; U.S. Pat. No. 4,659,614, issued on Apr. 21, 1987 to Vitale; and, U.S. Pat. No. 5,096,532, issued on Mar. 17, 1992 to Neuwirth et al.

Other techniques may be applied, including, without limitation, application of electron beams to fuse adjacent fibers or to activate an adhesive; photocuring of resins contacting the fabric strips; through-air bonding; sewing of webs of material; application of rivets, staples, snaps, grommets, or other mechanical fasteners; hook-and-loop attachment means; or, mechanical needling of the web of material. Methods and equipment for joining nonwoven webs of material with mechanical needling are disclosed in U.S. Pat. No. 5,713,399, issued on Feb. 3, 1998 to Collette et al.; U.S. Pat. No. 3,729,785, issued on May 1, 1973 to Sommer; U.S. Pat. No. 3,890,681, issued on Jun. 24, 1975 to Fekete et al.; U.S. Pat. No. 4,962,576, issued on Oct. 16, 1990 to Minichshofer et al.; and, U.S. Pat. No. 5,511,294, issued on Apr. 30, 1996 to Fehrer, as well as EP 1 063 349 A2, published on Dec. 27, 2000 in the name of Paquin, all of which are herein incorporated by reference to the extent that they are non-contradictory herewith. Needling (such as pin seaming) and aperturing, as well as other systems, have the potential to induce favorable changes in physical properties of the web of material such as increased permeability or improved fluid intake of the non-woven tissue making fabric.

When a hotmelt adhesive is used, the equipment for processing the hotmelt adhesive and supplying a stream of hotmelt adhesive to the printing systems of the present invention may be any known hotmelt or adhesive processing devices. For example, the ProFlex® applicators of Hot Melt Technologies, Inc. (Rochester, Mich.), the "S" Series Adhesive Supply Units of ITW Dynatec, Hendersonville, Tenn., as well as the DynaMelt "M" Series Adhesive Supply Units, the Melt-on-Demand Hopper, and the Hotmelt Adhesive Feeder, all of ITW Dynatec are all exemplary systems which may be used.

Binder materials may also be applied to one or more webs of material or portions thereof in the form of liquid resins, slurries, colloidal suspensions, or solutions that become rigid or crosslinked upon application of energy (e.g., microwave energy, heat, ultraviolet radiation, electron beam radiation, and the like). For example, Stypol XP44-AB12-51B of Freeman Chemical Corp., a diluted version of the Freeman 44-7010 binder, is a microwave-sensitive binder that was used by Buckley et al. in U.S. Pat. No. 6,001,300, issued on Dec. 14, 1999, previously incorporated by reference. Various types of thermosetting binders are known to the art such as polyvinyl acetate, vinyl acetate, ethylene-vinyl chloride, styrene butadiene, polyvinyl alcohol, polyethers, and the like. A heat-activated adhesive film is disclosed in EP 1 063 349 A2, published on Dec. 27, 2000 in the name of Paquin, wherein it is herein incorporated by reference to the extent that it is not contradictory herewith.

As used herein, the term "non-woven" indicates that the material in question was produced without weaving techniques. Weaving processes produce a structure of individual strands which are interwoven generally in an identifiable repeating manner. Non-woven materials may be formed by a variety of processes such as meltblowing, spunbonding, and staple fiber carding. The term "non-woven" frequently refers to fibrous materials, but may also refer to non-fibrous material or webs that comprise non-fibrous materials, such as photocured resin elements or polymeric foams. However, in some embodiments, the non-woven materials of the present invention may be predominantly fibrous, or may be substantially free of non-fibrous protrusions on the paper-contacting side of the web. For example, the non-woven tissue making fabric of the present invention may comprise about 50 weight % or more fibrous non-woven materials, specifically about 70 weight % or more, more specifically about 80 weight % or more, more specifically still about 90 weight % or more, and most specifically about 95 weight % or more fibrous non-woven materials. In another embodiment, the non-woven tissue making fabrics may be substantially free of photocured polymeric resins, or substantially free of polymeric foams. Further, the non-woven tissue making fabrics of the present invention may be substantially free of elevated non-thermoplastic resinous elements on the tissue contacting surface of the non-woven tissue making fabric.

The non-woven tissue making fabric may be reinforced with added fabric strips of material where needed, including layers of scrim, tow, woven materials, cured resins, and fabric strips of nonwoven material in any direction (e.g., lying in the cross-directional or machine directional or any direction therebetween).

The materials used may also vary with position in the non-woven tissue making fabric to obtain desirable material or mechanical properties. For example, the non-woven material may be polyester in most locations of the non-woven tissue making fabric, supplemented with polyphenylsulfide, polyether ether ketone, or a polyaramid at the side edges of the non-woven tissue making fabric to better resist hydrolysis, withstand elevated temperatures in a drying hood, or resist other mechanical or thermal challenges exacerbated at the side edges.

DETAILED DESCRIPTION

Figure 1:
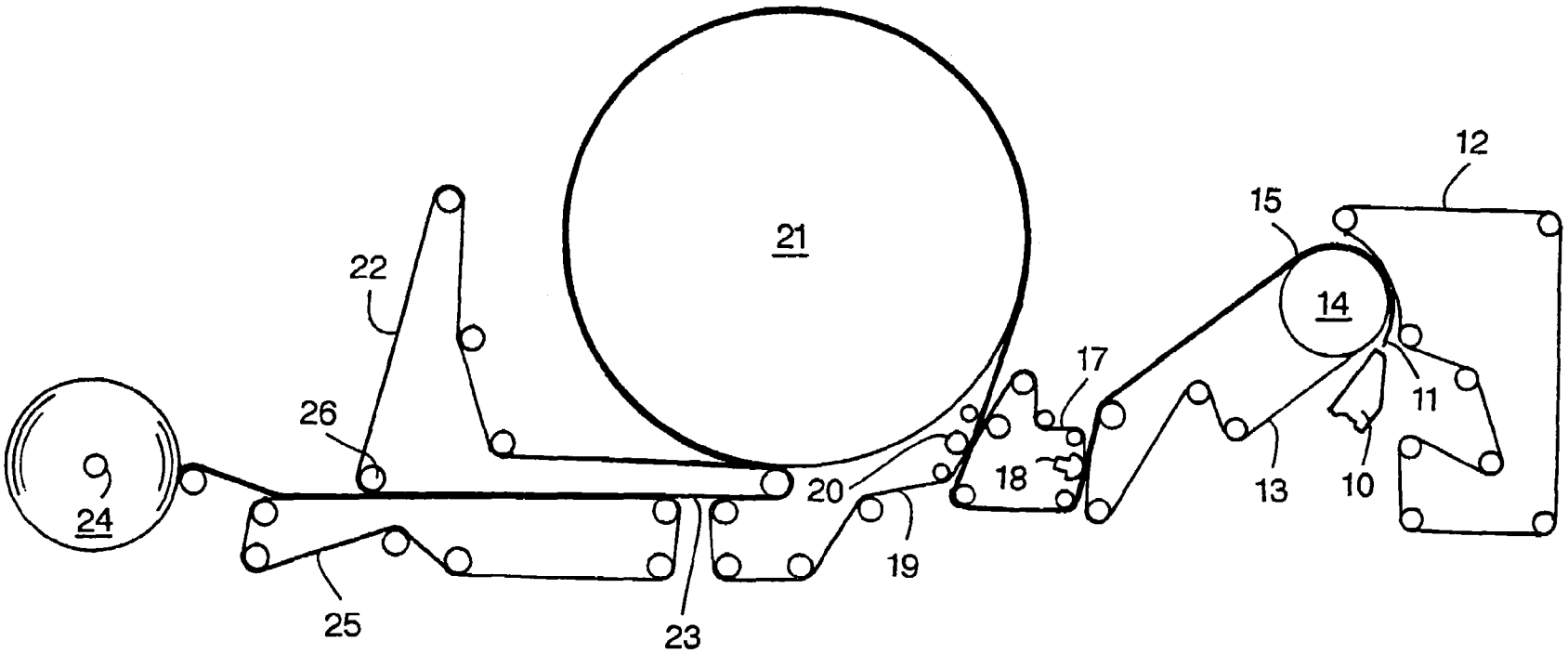
FIG. 1 is a schematic of a papermaking apparatus.

Referring to FIG. 1, a process of carrying out using the present invention will be described in greater detail. The process shown depicts an uncreped through dried process, but it will be recognized that any known papermaking method or tissue making method can be used in conjunction with the non-woven tissue making fabrics of the present invention. Related uncreped through air dried tissue processes are described in U.S. Pat. No. 5,656,132 issued on Aug. 12, 1997 to Farrington et al. and in U.S. Pat. No. 6,017,417 issued on Jan. 25, 2000 to Wendt et al. Both patents are herein incorporated by reference to the extent they are not contradictory herewith. Exemplary methods for the production of creped tissue and other paper products are disclosed in U.S. Pat. No. 5,855,739, issued on Jan. 5, 1999 to Ampulski et al.; U.S. Pat. No. 5,897,745, issued on Apr. 27, 1999 to Ampulski et al.; U.S. Pat. No. 5,893,965, issued on Apr. 13, 1999 to Trokhan et al.; U.S. Pat. No. 5,972,813 issued on Oct. 26, 1999 to Polat et al.; U.S. Pat. No. 5,503,715, issued on Apr. 2, 1996 to Trokhan et al.; U.S. Pat. No. 5,935,381, issued on Aug. 10, 1999 to Trokhan et al.; U.S. Pat. No. 4,529,480, issued on Jul. 16, 1985 to Trokhan; U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992 to Smurkoski et al.; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Stelljes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996, to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; U.S. Pat. No. 6,010,598, issued on Jan. 4, 2000 to Boutilier et al.; and, U.S. Pat. No. 5,628,876, issued on May 13, 1997 to Ayers et al., the specification and claims of which are incorporated herein by reference to the extent that they are not contradictory herewith.

In FIG. 1, a twin wire former 8 having a papermaking headbox 10 injects or deposits a stream 11 of an aqueous suspension of papermaking fibers onto a plurality of forming fabrics, such as the outer forming fabric 12 and the inner forming fabric 13, thereby forming a wet tissue web 15. The forming process of the present invention may be any conventional forming process known in the papermaking industry. Such formation processes include, but are not limited to, Fourdriniers, roof formers such as suction breast roll formers, and gap formers such as twin wire formers and crescent formers.

The wet tissue web 15 forms on the inner forming fabric 13 as the inner forming fabric 13 revolves about a forming roll 14. The inner forming fabric 13 serves to support and carry the newly-formed wet tissue web 15 downstream in the process as the wet tissue web 15 is partially dewatered to a consistency of about 10 percent based on the dry weight of the fibers. Additional dewatering of the wet tissue web 15 may be carried out by known paper making techniques, such as vacuum suction boxes, while the inner forming fabric 13 supports the wet tissue web 15. The wet tissue web 15 may be additionally dewatered to a consistency of at least about 20%, more specifically between about 20% to about 40%, and more specifically about 20% to about 30%. The wet tissue web 15 is then transferred from the inner forming fabric 13 to a transfer fabric 17 traveling preferably at a slower speed than the inner forming fabric 13 in order to impart increased MD stretch into the wet tissue web 15.

The wet tissue web 15 is then transferred from the transfer fabric 17 to a throughdrying fabric 19 whereby the wet tissue web 15 may be macroscopically rearranged to conform to the surface of the throughdrying fabric 19 with the aid of a vacuum transfer roll 20 or a vacuum transfer shoe like the vacuum shoe 18. If desired, the throughdrying fabric 19 can be run at a speed slower than the speed of the transfer fabric 17 to further enhance MD stretch of the resulting absorbent tissue product 27. The transfer may be carried out with vacuum assistance to ensure conformation of the wet tissue web 15 to the topography of the throughdrying fabric 19.

While supported by the throughdrying fabric 19, the wet tissue web 15 is dried to a final consistency of about 94 percent or greater by a throughdryer 21 and is thereafter transferred to a carrier fabric 22. Alternatively, the drying process can be any noncompressive drying method that tends to preserve the bulk of the wet tissue web 15.

The dried tissue web 23 is transported to a reel 24 using a carrier fabric 22 and an optional carrier fabric 25. An optional pressurized turning roll 26 can be used to facilitate transfer of the dried tissue web 23 from the carrier fabric 22 to the carrier fabric 25. If desired, the dried tissue web 23 may additionally be embossed to produce a pattern on the absorbent tissue product 27 produced using the throughdrying fabric 19 and a subsequent embossing stage.

Once the wet tissue web 15 has been non-compressively dried, thereby forming the dried tissue web 23, it is possible to crepe the dried tissue web 23 by transferring the dried tissue web 23 to a Yankee dryer prior to reeling, or using alternative foreshortening methods such as microcreping as disclosed in U.S. Pat. No. 4,919,877 issued on Apr. 24, 1990 to Parsons et al.

In an alternative embodiment not shown, the wet tissue web 15 may be transferred directly from the inner forming fabric 13 to the throughdrying fabric 19 and the transfer fabric 17 eliminated. The throughdrying fabric 19 may be traveling at a speed less than the inner forming fabric 13 such that the wet tissue web 15 is rush transferred, or, in the alternative, the throughdrying fabric 19 may be traveling at substantially the same speed as the inner forming fabric 13. If the throughdrying fabric 19 is traveling at a slower speed than the speed of the inner forming fabric 13, an uncreped absorbent tissue product 27 is produced. Additional foreshortening after the drying stage may be employed to improve the MD stretch of the absorbent tissue product 27. Methods of foreshortening the absorbent tissue product 27 include, by way of illustration and without limitation, conventional Yankee dryer creping, microcreping, or any other method known in the art.

Differential velocity transfer from one fabric to another can follow the principles taught in any one of the following patents, each of which is herein incorporated by reference to the extent it is not contradictory herewith: U.S. Pat. No. 5,667,636, issued on Sep. 16, 1997 to Engel et al.; U.S. Pat. No. 5,830,321, issued on Nov. 3, 1998 to Lindsay et al.; U.S. Pat. No. 4,440,597, issued on Apr. 3, 1984 to Wells et al.; U.S. Pat. No. 4,551,199, issued on Nov. 5, 1985 to Weldon; and, U.S. Pat. No. 4,849,054, issued on Jul. 18, 1989 to Klowak.

In yet another alternative embodiment of the present invention, the inner forming fabric 13, the transfer fabric 17, and the throughdrying fabric 19 can all be traveling at substantially the same speed. Foreshortening may be employed to improve MD stretch of the absorbent tissue product 27. Such methods include, by way of illustration without limitation, conventional Yankee dryer creping or microcreping.

Any known papermaking or tissue manufacturing method may be used to create a web 23 using the non-woven tissue making fabrics 30 of the present invention. Though the non-woven tissue making fabrics 30 of the present invention are especially useful as transfer and through drying fabrics and can be used with any known tissue making process that employs throughdrying, the non-woven tissue making fabrics 30 of the present invention can also be used in the formation of wet tissue webs 15 as forming fabrics, carrier fabrics, drying fabrics, imprinting fabrics, and the like in any known papermaking or tissue making process. Such methods can include variations comprising any one or more of the following steps in any feasible combination:

- wet tissue web formation in a wet end in the form of a classical Fourdrinier, a gap former, a twin-wire former, a crescent former, or any other known former comprising any known headbox, including a stratified headbox for bringing layers of two or more furnishes together into a single tissue web, or a plurality of headboxes for forming a multi-layered tissue web, using known wires and fabrics or the non-woven tissue making fabrics 30 of the present invention;
- wet tissue web formation or wet tissue web dewatering by foam-based processes, such as processes wherein the fibers are entrained or suspended in a foam prior to dewatering, or wherein foam is applied to an embryonic wet tissue web prior to dewatering or drying, including the methods disclosed in U.S. Pat. No. 5,178,729, issued on Jan. 12, 1993 to Janda, and U.S. Pat. No. 6,103,060, issued on Aug. 15, 2000 to Munerelle et al., both of which are herein incorporated by reference to the extent they are not contradictory herewith;
- differential basis weight formation by draining a slurry through a forming fabric having high and low permeability regions, including the non-woven tissue making fabrics 30 of the present invention or any known forming fabric;
- rush transfer of a wet tissue web from a first fabric to a second fabric moving at a slower velocity than the first fabric, wherein the first fabric can be a forming fabric, a transfer fabric, or a throughdrying fabric, and wherein the second fabric can be a transfer fabric, a throughdrying fabric, a second throughdrying fabric, or a carrier fabric disposed after a throughdrying fabric (one exemplary rush transfer process is disclosed in U.S. Pat. No. 4,440,597, issued on Apr. 3, 1984 to Wells et al., herein incorporated by reference to the extent that it is non-contradictory herewith), wherein the aforementioned fabrics can be selected from any suitable fabrics known in the art or the non-woven tissue making fabrics 30 of the present invention;
- application of differential air pressure across the wet tissue web to mold it into one or more of the fabrics on which the wet tissue web rests, such as using a high vacuum pressure in a vacuum transfer roll or transfer shoe to mold a wet tissue web into a throughdrying fabric as it is transferred from a forming fabric or intermediate carrier fabric, wherein the carrier fabric, throughdrying fabric, or other fabrics can be selected from the non-woven tissue making fabrics 30 of the present invention or other fabrics known in the art;
- use of an air press or other gaseous dewatering methods to increase the dryness of a tissue web and/or to impart molding to the tissue web, as disclosed in U.S. Pat. No. 6,096,169, issued on Aug. 1, 2000 to Hermans et al.; U.S. Pat. No. 6,197,154, issued on Mar. 6, 2001 to Chen et al.; and, U.S. Pat. No. 6,143,135, issued on Nov. 7, 2000 to Hada et al., all of which are herein incorporated by reference to the extent they are not contradictory herewith;
- drying the wet tissue web by any compressive or non-compressive drying process, such as throughdrying, drum drying, infrared drying, microwave drying, wet pressing, impulse drying (e.g., the methods disclosed in U.S. Pat. No. 5,353,521, issued on Oct. 11, 1994 to Orloff and U.S. Pat. No. 5,598,642, issued on Feb. 4, 1997 to Orloff et al.), high intensity nip dewatering, displacement dewatering (see J. D. Lindsay, "Displacement Dewatering To Maintain Bulk," *Paperi Ja Puu*, vol. 74, No. 3, 1992, pp. 232-242), capillary dewatering (see any of U.S. Pat. Nos. 5,598,643; 5,701,682; and 5,699,626, all of which issued to Chuang et al.), steam drying, etc.
- printing, coating, spraying, or otherwise transferring a chemical agent or compound on one or more sides of the wet tissue web uniformly or heterogeneously, as in a pattern, wherein any known agent or compound useful for a web-based product can be used (e.g., a softness agent such as a quaternary ammonium compound, a silicone agent, an emollient, a skin-wellness agent such as aloe vera extract, an antimicrobial agent such as citric acid, an odor-control agent, a pH control agent, a sizing agent; a polysaccharide derivative, a wet strength agent, a dye, a fragrance, and the like), including the methods of U.S. Pat. No. 5,871,763, issued on Feb. 16, 1999 to Luu et al.; U.S. Pat. No. 5,716,692, issued on Feb. 10, 1998 to Warner et al.; U.S. Pat. No. 5,573,637, issued on Nov. 12, 1996 to Ampulski et al.; U.S. Pat. No. 5,607,980, issued on Mar. 4, 1997 to McAtee et al.; U.S. Pat. No. 5,614,293, issued on Mar. 25, 1997 to Krzysik et al.; U.S. Pat. No. 5,643,588, issued on Jul. 1, 1997 to Roe et al.; U.S. Pat. No. 5,650,218, issued on Jul. 22, 1997 to Krzysik et al.; U.S. Pat. No. 5,990,377, issued on Nov. 23, 1999 to Chen et al.; and, U.S. Pat. No. 5,227,242, issued on Jul. 13, 1993 to Walter et al., each of which is herein incorporated by reference to the extent they are not contradictory herewith;

imprinting the wet tissue web on a Yankee dryer or other solid surface, wherein the wet tissue web resides on a fabric that can have deflection conduits (openings) and elevated regions (including the fabrics of the present invention), and the fabric is pressed against a surface such as the surface of a Yankee dryer to transfer the wet tissue web from the fabric to the surface of the Yankee dryer, thereby imparting densification to portions of the wet tissue web that were in contact with the elevated regions of the fabric, whereafter the selectively densified dried tissue web can be creped from or otherwise removed from the surface of the Yankee dryer;

creping the dried tissue web from a drum dryer, optionally after application of a strength agent such as latex to one or more sides of the tissue web, as exemplified by the methods disclosed in U.S. Pat. No. 3,879,257, issued on Apr. 22, 1975 to Gentile et al.; U.S. Pat. No. 5,885,418, issued on Mar. 23, 1999 to Anderson et al.; U.S. Pat. No. 6,149,768, issued on Nov. 21, 2000 to Hepford, all of which are herein incorporated by reference to the extent they are not contradictory herewith;

creping with serrated crepe blades (e.g., see U.S. Pat. No. 5,885,416, issued on Mar. 23, 1999 to Marinack et al.) or any other known creping or foreshortening method; and, converting the tissue web with known operations such as calendering, embossing, slitting, printing, forming a multiply structure having two, three, four, or more plies, putting on a roll or in a box or adapting for other dispensing means, packaging in any known form, and the like.

Figure 2A:
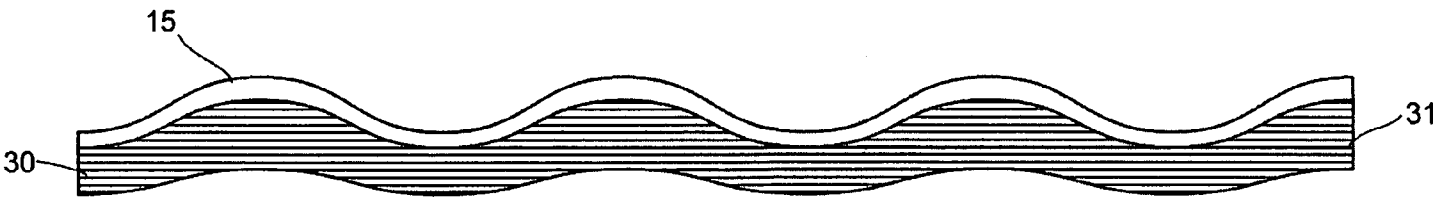
FIGS. 2A, 2B, and 2C depict cross-sections of an embryonic web on a non-woven tissue making fabric.
Figure 2B:
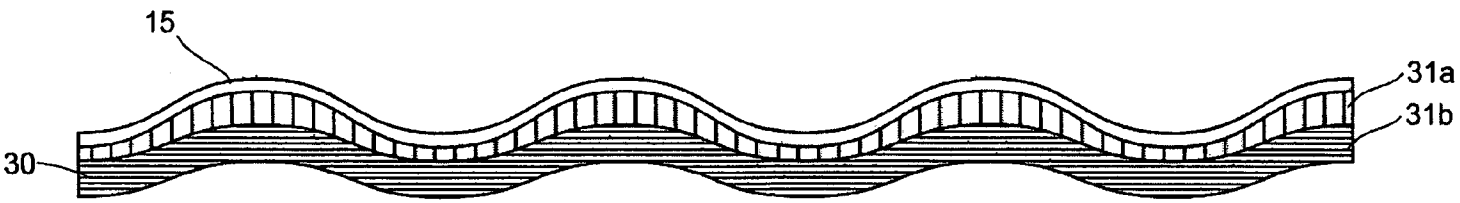

The present invention resides in a process for making tissue wherein the fibrous tissue web, prior to complete drying, transferred onto a non-woven tissue making fabric 30 comprising at least one layer of a porous synthetic polymeric, ceramic, or metallic non-woven material 31 in contact with the wet tissue web 15. An embodiment of such a non-woven tissue making fabric 30 is shown in FIGS. 2A and 2B, showing a cross-section of a porous non-woven tissue making fabric 30 with an embryonic wet tissue web 15 superposed thereon, such as a tissue web in the process of being through-air dried on the three-dimensional non-woven tissue making fabric 30 as depicted. As shown in FIG. 2A, the tissue making fabric 30 comprises a ply of non-woven material 31. In FIG. 2B, the non-woven tissue making fabric 30 comprises a first ply of non-woven material 31*a* joined to an underlying second ply of non-woven material 31*b*. Alternatively, the second ply 31*b* may be replaced with a woven layer (not shown). Alternatively, the first ply of non-woven material 31*a* may be replaced with a three-dimensional woven layer which may comprise the tissue contacting surface of the resulting tissue making fabric 30.

In other embodiments of the present invention (not shown), the tissue making fabric 30 may comprise a ply of non-woven material 31 and a ply of woven material. The non-woven tissue making fabric 30 may comprise a first ply of woven material joined to an underlying second ply of non-woven material 31*b*.

Figure 2C:
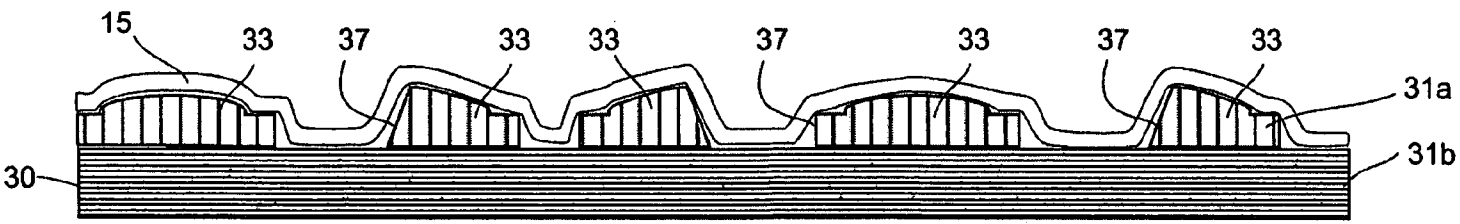

In FIG. 2C, a lower non-woven ply 31*b* has been provided with elevated non-woven photocured deflection elements 33 defining an upper layer 31*a* of non-woven material. The deflection elements 33 have openings 37 therebetween (deflection conduits) into which the wet tissue web 15 may be deflected in the presence of an air pressure differential or by pressing operations to create a three-dimensional effect in the wet tissue web 15. The deflection elements 33, as shown are asymmetrical, have a three-dimensional topography (as opposed to flat or macroscopically monoplanar deflection elements), according to the teachings in commonly owned U.S. patent application Ser. No. 09/705,684, previously incorporated by reference, but symmetrical deflection elements may also be used. The deflection elements 33 may be part of a continuous network or may be isolated islands of photocured resin. The deflection elements 33 need not be impervious, but may comprise a plurality of pores through which gas can flow. For example, the deflection elements 33 may comprise an open-celled foam or other porous material. The deflection elements 33 need not be photocured, but may be cured by free radical polymerization, thermosetting, electron beam curing, ultrasonic curing, and other methods known in the art.

Regarding FIG. 2C, the three-dimensional features of the non-woven tissue making fabric 30, in general may comprise non-fibrous polymeric protrusions or an elevated polymeric network, created by applying a layer of photocurable resin to a ply of non-woven material 31*b*, then selectively photocuring portions of the resin by application of actinic or other radiation through a mask to create a pattern or network of cured resin, followed by removal of uncured resin, to create a photocured layer attached to an underlying layer or ply of material. Exemplary methods for such processes are disclosed in U.S. Pat. No. 6,420,100, issued on Jul. 16, 2002 to Trokhan et al. and U.S. Pat. No. 5,817,377, issued on Oct. 6, 1998 to Trokhan et al., both of which are herein incorporated by reference to the extent that they are non-contradictory herewith, as well as U.S. Pat. No. 4,514,345, issued on Apr. 30, 1985 to Johnson et al. and U.S. Pat. No. 5,334,289, issued on Aug. 2, 1994 to Trokhan et al., both of which were previously incorporated by reference. Further improvements in these methods have been disclosed by Lindsay et al. in commonly owned U.S. patent application Ser. No. 09/705,684, herein incorporated by reference to the extent that it is non-contradictory herewith.

The topography of the non-woven tissue making fabric 30 in FIG. 2C illustrates a feature that is possible in many of the embodiments of the present invention, namely, that the surface of the non-woven tissue making fabric 30 need not be monoplanar, but can have a complex topography with raised and depressed elements at a variety of heights (e.g., raised elements at two or more heights relative to the plane of an underlying layer). The wet tissue web 15 through-dried on such a non-woven tissue making fabric 30 may have a complex topography as well, with an Overall Surface Depth of about 0.2 mm or greater, more specifically about 0.3 mm or greater, and most specifically about 0.4 mm or greater.

"*Overall Surface Depth*," described more fully hereafter, is a measure of the topography of a surface, indicative of a characteristic height different between elevated and depressed portions of the surface of the non-woven tissue making fabric 30. The Overall Surface Depth of non-apertured portions of the non-woven tissue making fabric 30 may likewise be about 0.2 mm or greater, more specifically about 0.3 mm or greater, and most specifically about 0.4 mm or greater. In some embodiments, even greater ranges are possible, such as about 0.5 mm or greater (e.g., from about 0.5 mm to about 3 mm or from about 0.5 mm to about 2 mm), more specifically about 0.8 mm or greater, and most specifically about 1.5 mm or greater. The thickness of the non-woven tissue making fabric 30 may be about 1 mm or greater, more specifically about 3 mm or greater, most specifically about 6 mm or greater, and may be about 10 mm or less, about 7 mm or less, or about 5 mm or less.

It is understood that, in the structures shown in FIGS. 2A, 2B, and 2C, the tissue machine contacting surface 50 may have a topography substantially independent of the topography of the tissue contacting surface 51. The non-20 woven tissue making fabric 30 may have a relatively uniform basis weight; low density, high caliper regions; high density, low caliper regions; high basis weight regions alternating with low basis weight regions; and/or, combinations thereof.

When the non-woven tissue making fabric 30 comprises more than one layer, as it does in FIGS. 2B and 2C, each layer of non-woven material 31*a* and 31*b* in the non-woven tissue making fabric 30 (or the entire non-woven material 31 as depicted in FIG. 2A) may independently be in the form of fibrous mats or webs of material, such as bonded carded webs, airlaid webs, scrim, needled webs, extruded networks, and the like, or foams, which may be open cell or reticulated foams, as well as extruded foams, including extruded polyurethane foams. Suitable polymers may comprise polyester, polyurethane, vinyl, acrylic, polycarbonates, nylon, polyamides (e.g., nylon 6, nylon 66, etc.), polyethylene, polypropylene, polybutylene terephthalate (PBT), polyphenylsulfide (PPS), Nomex® or Kevlar® (both manufactured by DuPont), syndiotactic polystyrene, polyacrylonitrile, phenolic resins, polyvinyl chloride, polymethacrylates, polymethacrylic acids, polyether ether ketone (PEEK), and the like, as well as copolymers and homopolymers thereof. Useful polymers may also include liquid crystal polymers (e.g., polyesters) and other high-temperature polymers and specialty polymers, such as those available from Ticona Corp. (Summit, N.J.), including Vectra™; Celanex® or Vandar® thermoplastic polyester; Riteflex® thermoplastic polyester elastomer; long fiber reinforced thermoplastics such as Compel®, Celstran®, and Fiberod® products; Topas® cyclic-olefin copolymer; Duracon®, Celcon®, and Hostaform® acetal copolymers; Fortron® polyphenylene sulfide; and, Duranex™ thermoplastic polyester (PBT). For fibrous mats of material, the non-woven materials 31 may be either the synthetic polymers mentioned above or optionally a bulky ceramic material such as fiberglass or fibrous ceramic materials commonly used as filters or insulating material, including alumina or silicate structures produced by Thermal Ceramics, Inc. of Augusta, Ga., in the form of wet laid or air laid fiber mats, or may comprise composite fibers with mineral and synthetic components, or carbon fibers.

The non-woven material 31 may be stable to temperatures at or above about 110° C., specifically at or above about 130° C., more specifically at or above about 150° C., more specifically at or above about 170° C., and most specifically at or above about 190° C., in order to ensure a suitable life-time under intense drying conditions. Commercial polymeric fibers known for temperature resistance include polyesters; aramids, such as Nomex® fibers, manufactured by DuPont, Inc.; polyphenylsulfide; polyether ether ketone, PEEK such as having a glass transition temperature of 142° C. or 288° F.; and, the like. For durability at elevated temperatures, the glass transition temperature may be at or above about 60° C., such as about 80° C. or greater, specifically about 100° C. or greater, more specifically about 110° C. or greater, and most specifically about 120° C. or greater. Typically, the non-woven material 31 is sufficiently gas permeable throughout the breadth of the substrate such that no roughly circular region about 2.5 mm in diameter or greater, specifically about 1.5 mm in diameter or greater, more specifically about 0.9 mm in diameter or greater, and most specifically about 0.5 mm in diameter or greater will be substantially blocked from air flow under conditions of differential air pressure across the substrate with a pressure differential of about 0.1 psi or greater at a temperature of about 25° C.

The non-woven material 31 depicted in FIG. 2A (or the plies of non-woven materials 31*a* and 31*b* depicted in FIGS. 2B and 2C, hereafter generally understood to be comprised by reference to the non-woven material 31) may be reinforced by additional plies of non-woven material, scrim material, woven webs, polymeric or metallic filaments, and the like. Such reinforcing elements may be away from the paper-contacting side of the non-woven tissue making fabric, or do not form elevated regions that could affect the topography of the tissue web produced thereon.

In some embodiments, the non-woven tissue making fabric 30 is free of woven components, or, more specifically, does not have a ply or layer of woven polymeric filaments. In another embodiment, the non-woven tissue making fabric 30 consists essentially of non-woven materials 31 and means for binding the non-woven materials 31 one to another. In other embodiments of the present invention, the non-woven tissue making fabric 30 may comprise woven components and/or photocured elements. The woven components and/or photocured elements may comprise the tissue contacting surface 51 and/or the tissue machine contacting surface 50 and/or any portion therebetween of the non-woven tissue making fabric 30.

The non-woven material 31 may be intrinsically gas permeable to permit drying and molding of the wet tissue web 15 onto the non-woven tissue making fabric 30 by air flow through the wet tissue web 15 and the non-woven tissue making fabric 30. The permeability and/or porosity of a non-woven tissue making fabric 30 may be increased, if desired, by any method known in the art. For example, the non-woven material 31 may be provided with numerous holes or apertures (not shown), or selected regions of the non-woven tissue making fabric 30 may be thinned to decrease the resistance to air flow offered by the non-woven material 31. Such treatments can be applied before, after, or simultaneously with bonding of adjacent fabric strips 34 of the non-woven material 31. Specific operations for increasing the permeability of the non-woven material 31 and/or the non-woven tissue making fabric 30 include hot-pin aperturing, perf-embossing, cutting, drilling, debonding, needling, laser drilling, laser ablation, hydroentangling or general impact with high velocity jets or droplets of water or other liquids to rearrange fibers in the non-woven material 31, mechanical abrasion, peening the non-woven material 31 or impacting it with particles that pierce the non-woven material 31 or cause the non-woven material 31 to be relatively more open, and the like. Such non-woven material 31 and/or the non-woven tissue making fabric 30 may be manufactured such that the non-woven tissue making fabric 30 results in a more uniform drying rate and/or profile. In addition, the non-woven material 31 and/or the non-woven tissue making fabric 30 may be manufactured such that the non-woven tissue making fabric 30 provides more uniform air permeability characteristics.

Obviously, holes and apertures of various sizes may be provided in the layer of the non-woven material 31, but if they are used, the air pressure differential during transfer and through drying should be low enough to prevent excessive puncturing of the wet tissue web 15 over the apertures.

As used herein, the "Air Permeability" of the non-woven tissue making fabric 30 or the non-woven material 31 may be measured with the FX 3300 Air Permeability device manufactured by Textest AG (Zürich, Switzerland), set to a pressure of 125 Pa with the normal 7-cm diameter opening (38 square centimeters area), which gives readings of Air Permeability in cubic feet per minute (CFM) that are comparable to well-known Frazier Air Permeability measurements. The Air Permeability value for the non-woven tissue making fabric 30 or for the non-woven material 31 thereof (or any non-woven ply of the non-woven tissue making fabric 30) may be about 30 CFM or greater, such as any of the following values (about or greater): 50 CFM, 70 CFM, 100 CFM, 150 CFM, 200 CFM, 250 CFM, 300 CFM, 350 CFM, 400 CFM, 450 CFM, 500 CFM, 550 CFM, 600 CFM, 650 CFM, 700 CFM, 750 CFM, 800 CFM, 900 CFM, 1000 CFM, and 1100 CFM. Exemplary ranges include from about 200 CFM to about 1400 CFM, from about 300 CFM to about 1200 CFM, and from about 100 CFM to about 800 CFM. For some applications, low Air Permeability may be desirable. Thus, the Air Permeability of the non-woven tissue making fabric 30 may be about 500 CFM or less, about 400 CFM or less, about 300 CFM or less, or about 200 CFM or less, such as from about 30 CFM to about 150 CFM, and from about 0 CFM to about 50 CFM. Substantially water impervious or substantially air impervious non-woven tissue making fabrics 30 (or both air and liquid impervious fabrics) are within the scope of the present invention when no through-flow of fluid is needed.

The structure of the non-woven material 31 of the present invention may provide for a faster throughdrying rate at a given Air Permeability. Non-woven tissue making fabrics 30 may provide a more uniform basis weight network of small diameter fibers, more numerous, smaller orifices, and a higher fiber support tissue contacting surface 51. There more numerous, smaller orifices are anticipated to result in more numerous drying fronts in the wet tissue web 15 during throughdrying. The higher fiber support tissue contacting surface 51 is anticipated to result in fewer pinholes in the wet tissue web 15 during molding and throughdrying. The combination of more numerous drying fronts and fewer pinholes in the wet tissue web 15 during throughdrying is anticipated to result in a faster throughdrying rate at a given air permeability, or require less air permeability than conventional woven fabrics for a given throughdrying rate.

The non-woven material 31 may have sufficient resilience to maintain a three-dimensional structure under vacuum or pneumatic pressure levels typical of through drying or impingement drying. However, the non-woven material 31 may also have a degree of compressibility to permit deformation during mechanical loading or shear such that highly elevated elements on the surface of the non-woven material 31 or the resulting non-woven tissue making fabric 30 may deform without causing damage to the wet tissue web 15 during contact with another surface, as occurs during typical web transfer events, pressing events, watermarking, or transfer to a can dryer. While non-compressive drying may be valuable in some applications, compressive drying and pressing is also within the scope of the present invention. Further, even in non-compressive drying, it is recognized that somewhat compressive events may occur prior to drying or during normal wet handling operations which may have the effect of pressing or shearing a wet tissue web 15. During such operations, a wet tissue web 15 on a highly contoured substrate with high surface depth might suffer damage as only a small fraction of the wet tissue web 15 at the most elevated points might be required to bear the load, shear stress, or friction of the operation. Compressible deflection elements 33 may also help alleviate stress in the wet tissue web 15 during treatment by differential air pressure as stressed regions of the non-woven tissue making fabric 30 deform and distribute the stress to broader regions of the non-woven tissue making fabric 30.

Low Pressure Compressive Compliance of a non-woven material 31 may be measured by compressing a substantially planar sample of the non-woven material 31 having a basis weight above 50 gsm with a weighted platen of 3-inches in diameter to impart mechanical loads of 0.05 psi and then 0.2 psi, measuring the thickness of the sample while under such compressive loads. Subtracting the ratio of thickness at 0.2 psi to thickness at 0.05 psi from 1 yields the Low Pressure Compressive Compliance, or Low Pressure Compressive Compliance=1−(thickness at 0.2 psi/thickness at 0.05 psi). The Low Pressure Compressive Compliance should be about 0.05 or greater, specifically about 0.1 or greater, more specifically about 0.2 or greater, still more specifically about 0.3 or greater, and most specifically between about 0.2 and about 0.5.

High Pressure Compressive Compliance is measured using a pressure range of 0.2 and 2.0 psi in making the determination of compliance, otherwise performed as for Low Pressure Compressive Compliance. In other words, High Pressure Compressive Compliance=1−(thickness at 2.0 psi/thickness at 0.2 psi). The High Pressure Compressive Compliance should be about 0.05 or greater, specifically about 0.15 or greater, more specifically about 0.25 or greater, still more specifically about 0.35 or greater, and most specifically between about 0.1 and about 0.5.

A non-woven material 31 potentially suitable for the present invention is the polyurethane foam applied to a papermaking fabric as disclosed in U.S. Pat. No. 5,512,319, issued on Apr. 30, 1996 to Cook et al., herein incorporated by reference to the extent that it is non-contradictory herewith. Also of relevance to the present invention are the related papermaking fabrics by Voith Fabircs (Appleton, Wis.), sold under the trade names "SPECTRA" and "Olympus." The SPECTRA fabrics incorporate a polyurethane membrane on an underlying woven papermaking fabric or batt. Alternatively, related fabrics may consist entirely of extruded material. The sales literature on these composite fabrics shows the network to be largely planar with holes or apertures imparted by the extrusion process. However, the manufacturing process could be modified to create a more contoured, three-dimensional surface of varying height more suitable for the non-woven tissue making fabrics 30 of the present invention.

Also of potential use is the "Ribbed Spectra" design comprising two polyurethane regions of differing height. Such engineered fabrics have the potential to allow a wide range of three-dimensional structures to be achieved in a papermaking fabric. These fabrics are sold for use in pressing and forming, but for the present invention could be adapted for through drying. The technology may be limited to producing several discrete planar regions which differ in height. More three-dimensional or textured variations of the SPECTRA structures may be obtained by regulating the amount of resin applied to various regions of the composite fabric to yield a heterogeneous basis weight distribution to provide regions of varying height. Another method is carving or further shaping an existing composite fabric before or after hardening of the resin. For example, the structures can be modified by pressing against another textured surface before full hardening, or by selective abrasion, sanding, laser drilling, or other forms of mechanical removal of portions of the structure before or after hardening.

Several general methods may be applied to create three-dimensional non-woven tissue making fabrics 30 such as those of FIGS. 2A-2C. Photocuring of resins on a substrate has been previously discussed. In other embodiments, if a layer of the non-woven material 31 is attached to an woven underlying porous member 32 (not shown), the three-dimensional shaping of the layer (or layers) of non-woven material 31 may be carried out before or after attachment to the woven underlying porous member 32. In particular, the layer of non-woven material 31 may be given a three-dimensional structure by establishment of a heterogeneous basis weight distribution during forming or by post-processing which adds or removes material from the non-woven material 31 at desired locations. When additional material is added to a layer of non-woven material 31, such as a relatively uniform or planar layer, to thereby create a three-dimensional surface, the added material may be of a composition or nature other than that used to create the layer of non-woven material 31. Such composite three-dimensional non-woven tissue making fabrics 30 are within the scope of the present invention. For example, such a composite may comprise a first layer of a synthetic fibrous mat of non-woven material 31 in contact with an woven base fabric underlying porous member 32, with a second layer of non-woven material 31 such as a polyurethane foam or reticulated foam added to the exposed surface of selected regions of said first layer of non-woven material 31. The resulting composite non-woven tissue making fabric 30 may have heterogeneous basis weight, density, and/or chemical composition.

In another embodiment, a three-dimensional topography may be imparted to an upper ply by adding material heterogeneously between the upper ply and a neighboring lower ply (not shown) of the non-woven material 31. For example, beads of adhesive, pieces of foam, or cut pieces of non-woven material interposed between two neighboring plies of the non-woven material 31 may impart a three-dimensional structure to the upper ply.

There are several methods of producing fibers or filaments that may be used in the non-woven material 31 of the non-woven tissue making fabric 30 of the present invention; however, two commonly used processes are known as spunbonding and meltblowing and the resulting non-woven webs are known as spunbond and meltblown webs, respectively. As used herein, polymeric fibers and filaments are referred to generically as polymeric strands. In the context of non-woven webs, the terms "filaments" refers to continuous strands of material while the term "polymeric fibers" refers to cut or discontinuous strands having a definite length.

Generally described, the process for making spunbond non-woven webs includes extruding thermoplastic material through a spinneret and drawing the extruded material into filaments with a stream of high-velocity air to form a random web on a collecting surface. Such a method is referred to as meltspinning. Spunbond processes are generally defined in numerous patents including, for example, U.S. Pat. No. 3,692,618, issued on Sep. 19, 1972 to Dorschner, et al.; U.S. Pat. No. 4,340,563, issued on Jul. 20, 1982 to Appel, et al.; U.S. Pat. No. 3,338,992, issued on Aug. 29, 1967 to Kinney; U.S. Pat. No. 3,341,394, issued on Sep. 12, 1967 to Kinney; U.S. Pat. No. 3,502,538, issued on Mar. 24, 1970 to Levy; U.S. Pat. No. 3,502,763, issued on Mar. 24, 1970 to Hartmann; U.S. Pat. No. 3,542,615, issued on Nov. 24, 1970 to Dobo, et al.; and, Canadian Patent No. 803,714, issued on Jan. 14, 1969 to Harmon.

On the other hand, meltblown non-woven webs are made by extruding a thermoplastic material through one or more dies, blowing a high-velocity stream of air past the extrusion dies to generate an air-conveyed melt-blown fiber curtain and depositing the curtain of fibers onto a collecting surface to form a random non-woven web. Meltblowing processes are generally described innumerous publications including, for example, an article titled "Superfine Thermoplastic Fibers" by Wendt in Industrial and Engineering Chemistry, Vol. 48, No. 8, (1956), at pp. 1342-1346, which describes work done at the Naval Research Laboratories in Washington, D.C.; Naval Research Laboratory Report 111437, dated Apr. 15, 1954; U.S. Pat. No. 4,041,203, issued on Aug. 9, 1977 to Brock et al.; U.S. Pat. No. 3,715,251, issued on Feb. 6, 1973 to Prentice; U.S. Pat. No. 3,704,198, issued on Nov. 28, 1972 to Prentice; U.S. Pat. No. 3,676,242, issued on Jul. 11, 1972 to Prentice; and, U.S. Pat. No. 3,595,245, issued on Jul. 27, 1971 to Buntin et al. as well as British Specification No. 1,217,892, published on Dec. 31, 1970.

Spunbond and meltblown non-woven webs are usually distinguished by the diameters and the molecular orientation of the filaments or fibers which form the webs. The diameter of spunbond and meltblown filaments or fibers is the average cross-sectional dimension. Spunbond filaments or fibers typically have average diameters of about 6 microns or greater and often have average diameters in the range of about 15 to about 40 microns. Meltblown fibers typically have average diameters of about 15 microns or less and more specifically about 6 microns or less. However, because larger meltblown fibers, having diameters of about 6 microns or greater may also be produced, molecular orientation may be used to distinguish spunbond and meltblown filaments and fibers of similar diameters.

In the present invention, the average diameters of the filaments or fibers may be about 20 microns or greater, more specifically about 50 microns or greater, more specifically about 100 microns or greater, and most specifically about 300 microns or greater. The average diameters of the filaments or fibers may range from about 6 to about 700 microns, more specifically about 20 to about 500 microns, more specifically about 30 to about 300 microns, more specifically about 50 to about 200 microns, and most specifically about 100 microns.

For a given fiber or filament size and polymer, the molecular orientation of a spunbond fiber or filament is typically greater than the molecular orientation of a meltblown fiber. Relative molecular orientation of polymeric fibers or filaments can be determined by measuring the tensile strength and birefringence of fibers or filaments having the same diameter. Tensile strength of fibers and filaments is a measure of the stress required to stretch the fiber or filament until the fiber or filament breaks. Birefringence numbers are calculated according to the method described in the spring 1991 issue of *INDA Journal of Nonwovens Research*, (Vol. 3, No. 2, p. 27). The tensile strength and birefringence numbers of polymeric fibers and filaments vary depending on the particular polymer and other factors; however, for a given fiber or filament size and polymer, the tensile strength of a spunbond fiber or filament is typically greater than the tensile strength of a melt-blown fiber and the birefringence number of a spun-bond fiber or filament is typically greater than the birefringence number of a meltblown fiber.

If desired, the non-woven material 31 may comprise one or more plies of a laminate material, such as spunbonded/meltblown/spunbonded (SMS) laminate or a spunbond/meltblown (SM) laminate. An SMS laminate may be made by sequentially depositing onto a moving forming belt first a spunbond web layer, then a meltblown web layer and last another spunbond layer and then bonding the laminate in a manner described below. Alternatively, the web layers may be made individually, collected in rolls, and combined in a separate bonding step. SMS materials are described in U.S. Pat. No. 4,041,203, issued on Aug. 9, 1977 to Brock et al.; U.S. Pat. No. 5,464,688, issued on Nov. 7, 1995 to Timmons, et al.; U.S. Pat. No. 4,374,888, issued on Feb. 22, 1983 to Bornslaeger; U.S. Pat. No. 5,169,706, issued on Dec. 8, 1992 to Collier, et al.; and, U.S. Pat. No. 4,766,029, issued on Aug. 23, 1988 to Brock et al., all of which are herein incorporated by reference to the extent that they are non-contradictory herewith. For some non-woven tissue making fabrics 30 of the present invention, the laminates should be made having higher melting point polymers than those of conventional SMS materials, such as polyphenylsulfide or other high-temperature polymers.

In an effort to produce non-woven webs for use as non-woven materials 31 having desirable combinations of physical properties, multi-component or bi-component non-woven webs have been developed. Methods for making bi-component non-woven webs are well-known and are disclosed in patents such as Reissue Number 30,955 of U.S. Pat. No. 4,068,036, issued on Jan. 10, 1978 to Stanistreet; U.S. Pat. No. 3,423,266, issued on Jan. 21, 1969 to Davies et al.; and, U.S. Pat. No. 3,595,731, issued on Jul. 27, 1971 to Davies et al. A bi-component non-woven web may be made from polymeric fibers or filaments including first and second polymeric components which remain distinct. As used herein, filaments mean continuous strands of material and fibers mean cut or discontinuous strands having a definite length. The first and second components of multi-component filaments are arranged in substantially distinct zones across the cross-section of the filaments and extend continuously along the length of the filaments. Typically, one component exhibits different properties than the other so that the filaments exhibit properties of the two components. For example, one component may be polypropylene which is relatively strong and the other component maybe polyethylene which is relatively soft. The end result is a strong yet soft non-woven web. Bi-component structures may be selected depending on the needs of the layer of non-woven material 31 of the non-woven tissue making fabric 31 under consideration. Concentric sheath-core cross-section filaments may be useful for good strength properties, for example, while asymmertrical sheath-core cross-section filaments or side-by-side cross-section filaments can result in high-bulk non-wovens.

U.S. Pat. No. 3,423,266, issued on Jan. 21, 1969 to Davies et al. and U.S. Pat. No. 3,595,731, issued on Jul. 27, 1971 to Davies et al. disclose methods for melt spinning bi-component filaments to form non-woven polymeric webs suitable for use as non-woven material 31. The non-woven webs may be formed by cutting the meltspun filaments into staple fibers and then forming a bonded carded web or by laying the continuous bi-component filaments onto a forming surface and thereafter bonding the non-woven web. To increase the bulk of the bi-component non-woven webs, the bi-component fibers or filaments are often crimped. As disclosed in U.S. Pat. No. 3,595,731 and U.S. Pat. No. 3,423,266 (discussed above), the bi-component filaments maybe mechanically crimped and the resultant fibers formed into a non-woven web or, if the appropriate polymers are used, a latent helical crimp, produced in bi-component fibers or filaments may be activated by heat treatment of the formed non-woven web. The heat treatment is used to activate the helical crimp in the fibers or filaments after the fibers or filaments have been formed into a non-woven web.

While many applications of the present invention may include polymers capable of withstanding elevated temperatures, lower temperature applications such as wet pressing fabrics and in some cases, forming fabrics may also be contemplated. For such applications, polymers with lower melting points or glass transition temperatures ($T_G$) can be useful. And in some applications, improved processing of the non-woven material is possible at lower $T_G$. For example, the non-woven material may comprise a polymer or polymer blend having a $T_G$ Of about 60° C. or less, specifically about 50° C. or less, more specifically about 45° C. or less, and most specifically about 40° C. or less.

The non-woven tissue making fabric 30 may be further provided with wear-resistance elements (not shown) on the tissue machine surface (opposing the tissue contacting surface) that may be extruded polymeric beads, threads, bumps, berms, strips, and the like. Raised elements may also be added to improve traction with roll handling equipment. Similar elements may also be added to the tissue contacting surface and/or interior of the non-woven tissue making fabric 30.

Figure 3:
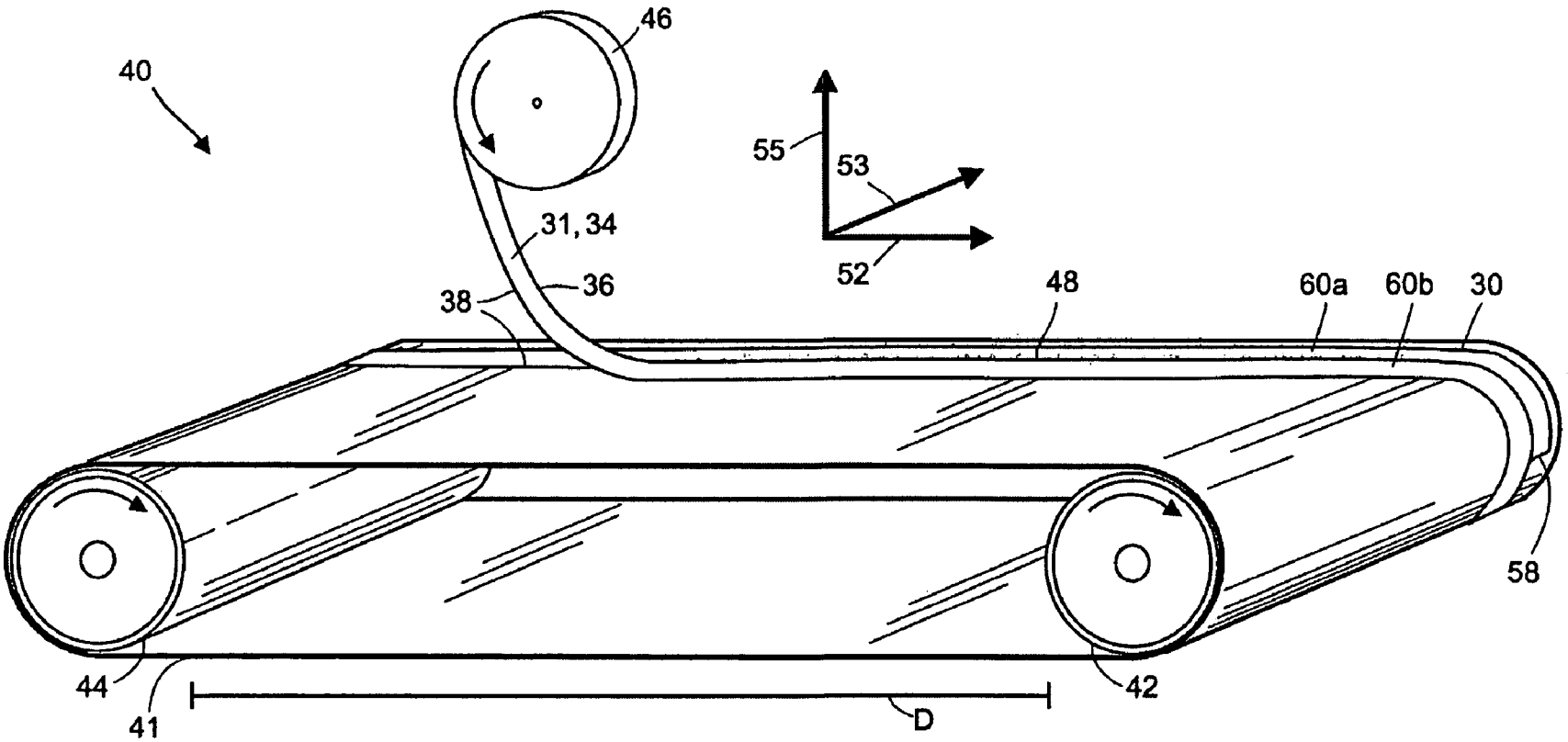
FIG. 3 is a schematic view of a method for manufacturing a non-woven tissue making fabric of one embodiment of the present invention.

FIG. 3 shows a schematic view of a method for manufacturing a non-woven tissue making fabric 30. One embodiment of the method uses an apparatus 40 comprising a first roll 42 and a second roll 44, which are parallel to each other and which may be rotated in the direction indicated by the arrows. A carrier fabric 41 loops around the two rolls 42 and 44, providing a moving surface onto which a fabric strip 34 of the non-woven material 31 may be disposed as it is unwound from a stock roll 46. The fabric strip 34 travels with the carrier fabric 41 to pass around the first roll 42 and the second roll 44 in a continuous spiral.

The carrier fabric 41 may be a textured, woven fabric such as a sculpted through-drying fabric disclosed in U.S. Pat. No. 6,017,417, issued on Jan. 25, 2000 to Wendt et al., previously incorporated by reference, or other fabrics or textured belts known in the art. In other embodiments of the present invention, a flat woven or non-woven carrier fabric 41 may be incorporated into tissue making fabric 30.

The process depicted in FIG. 3 is at an early stage in the formation of the non-woven tissue making fabric 30. The initial placement of the fabric strip 34 on the carrier fabric 41 forms the leading edge 58 of the spirally wound fabric strip 34 in the non-woven tissue making fabric 30. The non-woven material 31 on the carrier fabric 41 immediately behind the leading edge 58 is part of a first fabric turn **60*a* on the carrier fabric 41. The fabric strip 34, having made a complete revolution around the carrier fabric 41, is shown in the beginnings of a second fabric turn 60*b* which slightly overlaps the first fabric turn 60*a*. The overlapping region, once bonded (binding means are not shown), forms a seam 48**.

As the fabric strip 34 is disposed on the carrier fabric 41, the fabric strip 34 may be held in place by the presence of a light adhesive, pneumatic pressure (e.g., spaced apart vacuum boxes), electrostatic charge, mechanical restraint, elevated temperature, or other means.

According to embodiments wherein the carrier fabric 41 may be porous and textured, the texture may be applied to the non-woven material 31 through a combination of elevated temperature and/or mechanical force to mold the non-woven material 31 against the carrier fabric 41. According to embodiments of the present invention wherein the carrier fabric 41 may be textured, the texture may be applied to the non-woven material 31 through a combination of elevated temperature and mechanical force to mold the non-woven material 31 against the carrier fabric 41. The mechanical force may be a nip, such as a soft thick nip for a textured carrier fabric, or web tension around a curved surface. Elevated temperature may be provided by passing hot air through the wet tissue web 15 and the carrier fabric. Impingement and/or radiant heating may be used, even if the web of material 31 is impermeable.

In alternative embodiments of the present invention, the carrier fabric 41 may be replaced with a draw between the first roll 42 and the stock roll 46. The fabric strip 34 may then be bonded to the first fabric turn 60*a*. The binding step may occur on the first roll 42 to form the non-woven tissue making fabric 30. Tension may be applied between the first roll 42 and the stock roll 46, thereby providing a mechanical force to hold the fabric strip 34 during binding. The first roll 42 may be replaced with a vacuum transfer roll or other device that may increase the holding force during binding of the fabric strip 34 to the first fabric turn 60*a*.

As the fabric strip 34 is held in contact to the first fabric turn 60*a* on the first roll 42, the fabric strip 34 may be held in place by the presence of a light adhesive, pneumatic pressure (e.g., spaced apart vacuum boxes), electrostatic charge, mechanical restraint, elevated temperature, or other means.

The first roll 42 and the second roll 44 are separated by a distance D, such that the resulting endless non-woven tissue making fabric 30 is of the desired length, being measured in the machine direction 52 about the endless-loop of the non-woven tissue making fabric 30. (Also shown are the cross-direction 53 and the z-direction 55.) The width of the non-woven fabric strip 34 of the non-woven material 31 may be varied to reflect desired seam strength, ease of handling during manufacture, and trim waste values.

The non-woven fabric strip 34 of the non-woven material 31 may have a width ranging between about 1 inch and about 600 inches; between about 1 inch and about 300 inches; between about 2 inches and about 100 inches; between about 2 inches and about 50 inches; and, between about 3 inches and about 20 inches, or may have a width of about 12 inches or less, or a width of about 6 inches or less. In some embodiments of the present invention, the non-woven fabric strip 34 of the non-woven material 31 may have a width ranging between about 30 to about 100 inches. The fabric strip 34 of the non-woven material 31 has a first edge 36 and an opposing second edge 38. The fabric strip 34 is spirally wound onto the first and second rolls 42 and 44, respectively, in a plurality of revolutions of the stock roll 46. The resulting non-woven tissue making fabric 30 may have a continuous spiral seam 48 that passes around the endless loop comprising the non-woven tissue making fabric 30 a plurality of times. As will be seen, other seam configurations are possible, including multiple discrete seams in the machine direction, cross-direction, or other direction.

As the fabric strip 34 is wound around the carrier fabric 41, overlapping sections (turns, in this case) of the fabric strip 34 may be lightly tacked together with adhesive or other means until subsequent bonding and optional molding steps occur. In one embodiment, the tacked-together embryonic non-woven tissue making fabric 30 is subjected to thermal bonding with heated air, infrared radiation, a heated nip, or other means, followed by optional molding. In another embodiment, molding and bonding take place simultaneously. For example, the embryonic non-woven tissue making fabric 30 may be passed through a heated nip between opposing intermeshing textured rolls to thermally bond and mold the embryonic non-woven tissue making fabric 30 into a macroscopic three-dimensional texture suitable for through-air drying or other operations. Bonding can be done after the embryonic non-woven tissue making fabric 30 is removed from the carrier fabric 41, or while it remains thereon.

Figure 8A:
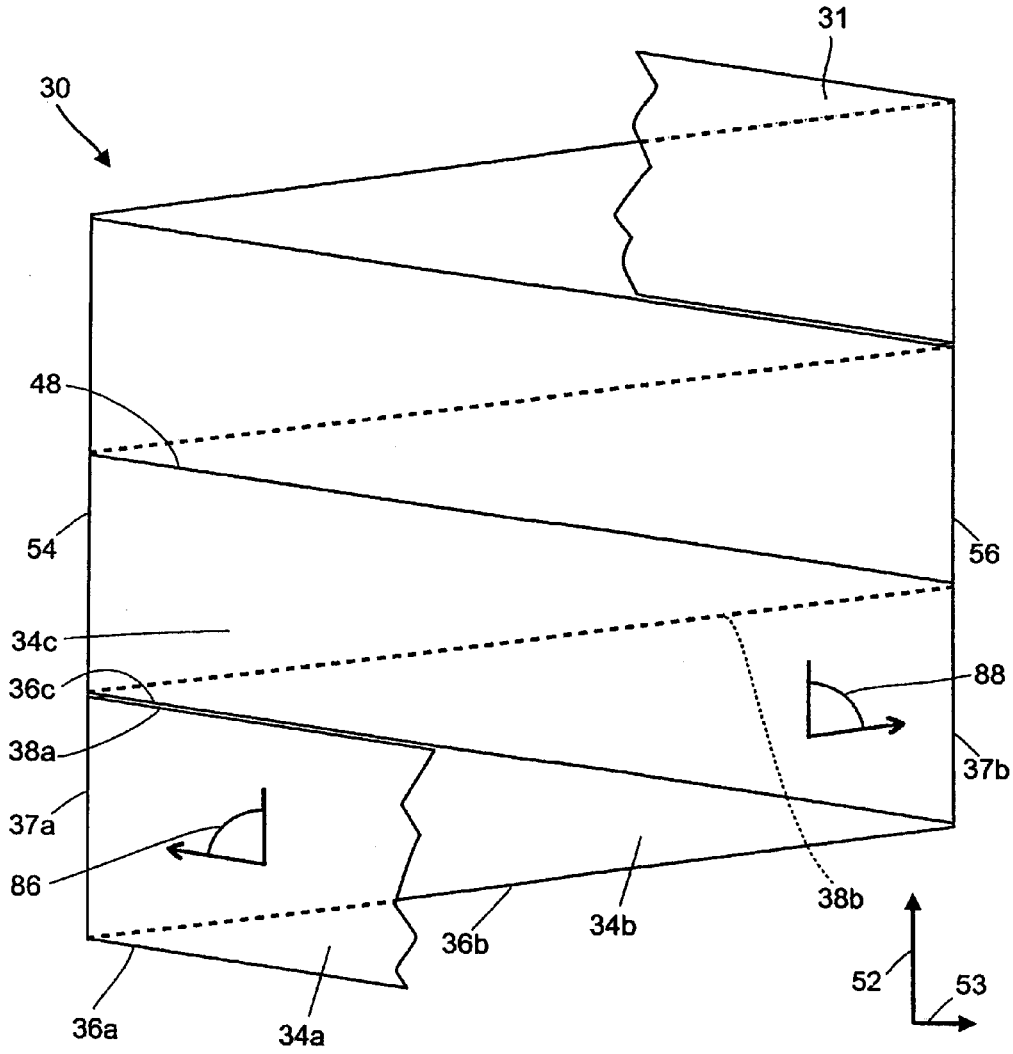
FIGS. 8A and 8B are schematic views of embodiments of non-woven tissue making fabrics according to the present invention comprising a fabric strip that is wound in a plurality of turns at an acute angle to the machine direction.

Successive turns of the fabric strip 34 of the non-woven material 31 are disposed relative to one another in an overlapping manner as illustrated hereafter, for example, in FIG. 8*a*, and are bonded to one another along a spirally continuous seam 48 thereby producing a non-woven tissue making fabric 30. It is understood that the bonding of the spiral seam 48 (or any other seam of the present invention) may be accomplished by any known method in the art. Such methods may include refastenable and non-refastenable methods. (See the discussion above). When the desired number of turns of the fabric strip 34 of the non-woven material 31 has been made to produce the desired width (W) of the non-woven tissue making fabric 30 as measured in the cross-machine direction of the nonwoven tissue making fabric 30, the spiral winding is concluded. The non-woven tissue making fabric 30 may have a W ranging between about 12 inches and about 500 inches; between about 50 inches and about 300 inches; between about 100 inches and about 250 inches; between about 120 inches and about 250 inches; and, about 200 inches.

According to one embodiment of the present invention, the fabric strip 34 of the non-woven material 31 is spirally wound in a plurality of contiguous turns such that the first edge 36 of the fabric strip 34 of the non-woven material 31 in one turn extends beyond the second edge 38 of the fabric strip 34 of the non-woven material 31 of an adjacent (the previous) turn of the fabric strip 34 of the non-woven material 31. The over-lapping of the first edge 36 of the fabric strip 34 of the non-woven material 31 over the second edge 38 of the fabric strip 34 of the non-woven material 31 on a previous turn creates a spirally continuous seam 48 and an endless non-woven tissue making fabric 30.

Upon completion of the spiral winding, the lateral edges of the non-woven tissue making fabric 30 may not be parallel to the machine direction 52 of the non-woven tissue making fabric 30. Such lateral edges will need to be trimmed to produce the first and second side edges 54 and 56 of the non-woven tissue making fabric 30 thereby establishing the non-woven tissue making fabric 30 having the desired width. The non-woven tissue making fabric 30 includes a machine direction 52, and a cross-machine direction 53.

In one embodiment, the strength of the non-woven tissue making fabric 30 or fabric seams may be increased by adding a scrim layer (not shown), such as a scrim layer sandwiched between two or more plies of the non-woven material 31 or the non-woven tissue making fabric 30. The scrim layer may be a rectangular grid, a hexagonal network, or any other network providing good tensile strength in at least one in-plane direction. The scrim layer may be formed of one or more materials such as a synthetic polymer, fiberglass, metal wires, a perforated film or foil, and the like.

Examples of scrim layers as a reinforcement for a nonwoven fabric or film are disclosed in the following patents: U.S. Pat. No. 4,363,684, issued on Dec. 14, 1982 to Hay; U.S. Pat. No. 4,731,276, issued on Mar. 15, 1988 to Manning et al.; U.S. Pat. No. 3,597,299, to Thomas et al.; and, U.S. Pat. No. 5,139,841, issued on Aug. 18, 1992 to Makoui et al., all of which are herein incorporated by reference to the extent that they are non-contradictory herewith. The scrim could be a highly open rectilinear grid of a polymeric material. Further examples of scrim suitable for reinforcing the non-woven tissue making fabric 30 of the present invention are disclosed in U.S. Pat. No. 4,522,863, issued on Jun. 11, 1985 to Keck et al.; U.S. Pat. No. 4,737,393, issued on Apr. 12, 1988 to Linkous; and, U.S. Pat. No. 5,038,775, issued on Aug. 13, 1991 to Maruscak et al., all of which are herein incorporated by reference to the extent that they are non-contradictory herewith. Production methods may also comprise the use of rotating nozzles to produce rectilinear threads of polymer. It is understood that scrim may also be used to add texture to the non-woven tissue making fabric 30. Scrim may also be added to the non-woven tissue making fabric 30 to provide or enhance wear resistance of the non-woven tissue making fabric 30. Scrim may be added to the tissue contacting surface 51, the tissue machine contacting surface 50, and/or the interior of the non-woven tissue making fabric 30.

Seams 48 may be reinforced with adhesive, sewn thread, ultrasonic welding, extra layers of material, an added scrim layer, and any other means known in the art. The nonwoven tissue making fabric 30 of the present invention may have a machine direction seam strength of about 100 pli (pounds per linear inch) or more, meaning that an in-plane machine direction tensile force of at least about 200 pounds per linear inch can be applied to a seam 48 (or to any portion of the non-woven tissue making fabric 30, if there is no seam 48 in the machine direction) without causing failure. More specifically, the non-woven tissue making fabric 30 may have a seam strength and/or belt strength of about 150 pli or greater, more specifically still about 200 pli or greater, more specifically still about 250 pli or greater, and most specifically about 350 pli or greater. Typical fabric tensions encountered by the non-woven tissue making fabric 30 during operation may be from about 2 pli to about 90 pli, specifically from about 5 pli to about 60 pli, more specifically from about 5 pli to about 25 pli, and most specifically from about 5 pli to about 15 pli, though operation outside these limits is not necessarily outside the scope of the present invention.

While high seam strengths are sometimes desirable, they are not necessary for all applications. Further, a spirally continuous seam 48 or other seams 48 of the present invention generally need not withstand the full machine direction tension normally present during use of the non-woven tissue making fabric 30, because the seams 48 in many embodiments of the present invention are not aligned with the cross-direction, as is often the case in conventional tissue machine fabrics, but rather at an angle to the cross-direction and may even be substantially aligned with the machine direction. Thus, the requirements for seam strength may be substantially mitigated due to the favorable geometry achieved in many embodiments of the non-woven tissue making fabric 30 of the present invention. In many such embodiments, good results may be obtained with seams 48 constructed to withstand forces normal to the seam 48 from about 2 to about 30 pli, more specifically from about 8 to about 25 pli, and most specifically from about 10 to about 20 pli.

Any known method may be used to control the position of a fabric strip 34 as it is laid down to form a non-woven tissue making fabric 30 according to the present invention. Illustrative tools for this purpose are disclosed in U.S. Pat. No. 4,962,576, issued on Oct. 16, 1990 to Minichshofer et al., herein incorporated by reference to the extent that it is non-contradictory herewith, which treats a system for joining a nonwoven fabric to a woven carrier. Such a system may be adapted such that a nonwoven web is joined to a nonwoven carrier for the purposes of the present invention. Minichshofer et al. employs a web guide in cooperative association with a needling system. Many other systems may be used in the present invention, such as image analysis systems or other optical systems coupled with standard web guide devices to track and control the location of the fabric strips 34, coupled with mechanical actuators to ensure the fabric strip 34 is placed correctly as the non-woven tissue making fabric 30 is formed. In another embodiment of the present invention, the first roll 42 and the second roll 44 are substantially parallel. Tension may be applied on the fabric strip 34 between the first and second rolls 42 and 44. The first and second rolls 42 and 44 may rotate at the same speed. With the application of a worm gear coupled to the rolls 42 and/or 44, the unwinding of the fabric strip 34 from the stock roll 46 at a set angle to the machine direction 52 may be affected.

The non-woven tissue making fabric 30 of the present invention or the non-woven materials 31 used therefor may be provided with texture by any known method. For example, portions of an upper ply, layer, or stratum (in some cases, forming the tissue contacting surface 51 or adjacent the tissue contacting surface 51 of the non-woven tissue making fabric 30) of the non-woven material 31 (or the non-woven tissue making fabric 30) may be selectively removed to impart texture, using any known removal method such as cutting, stamping, laser cutting, laser ablation, drilling, and the like. Portions of the tissue contacting surface 51 of the non-woven tissue making fabric 30 may also be selectively densified to create texture using any known method such as embossing, stamping, ultrasonic welding, thermal welding, hot pin aperturing, thermal molding, and the like. Further, additional material can be selectively added to regions of an otherwise planar non-woven tissue making fabric 30 to impart elevated regions for an overall three-dimensional topography. Such added material may comprise non-woven material 31 such as that used for one or more plies of the non-woven tissue making fabric 30, or other permeable material such as a polymeric foam, or even regions of substantially impermeable material. The added material may be attached by adhesives, thermal welding, ultrasonic welding, needling, or any other method known in the art. In a related embodiment, the added material may be applied to the non-woven tissue making fabric 30 by extruding the material on to the surface or by a printing technique, such as a hot melt or non-pressure-sensitive adhesive applied via ink jet printing, flexographic printing, and the like.

In one embodiment, an array of spaced apart pins is controlled by computer or other means such that selected pins strike the non-woven tissue making fabric 30 to density it or aperture the non-woven tissue making fabric 30 in a pattern. The pins may apply digitally controlled patterns to the non-woven tissue making fabric 30 in a manner similar to the generation of printed patterns using dot matrix printers, with the dots of the dot matrix printer being analogous to the pins in the pin array.

Thermoplastic non-woven material 31 may be provided with texture by molding methods, in which the non-woven material 31 (or the non-woven tissue making fabric 30) is elevated in temperature as the non-woven material 31 is constrained to take a three-dimensional shape by methods such as pressing the non-woven material 31 between molding plates, applying an air pressure differential to the non-woven material 31 as the non-woven material 31 rests on a three-dimensional surface such as the textured through-drying fabrics disclosed in U.S. Pat. No. 6,017,417, issued on Jan. 25, 2000 to Wendt et al., previously incorporated by reference; the textured fabrics disclosed in commonly owned U.S. patent application Ser. No. 09/705,684 by Lindsay et al.; the fabrics disclosed in U.S. Pat. No. 5,167,771, issued on Dec. 1, 1992 to Sayers et al.; or, the fabrics disclosed in U.S. Pat. No. 4,740,409, issued on Apr. 26, 1988 to Lefkowitz, all of which are herein incorporated by reference to the extent that they are non-contradictory herewith.

In addition, texture may be provided to the thermoplastic non-woven material 31 by placing the non-woven material 31 (or the non-woven tissue making fabric 30) under tension, such as wrapping the non-woven material 31 (or the non-woven tissue making fabric 30) about a roll (such as a first roll 42, a second roll 44 or a stock roll 46). Heat may or may not be used in addition to the tension.

The three-dimensional texture of the non-woven tissue making fabric 30 may comprise a repeating pattern, such as any pattern known in woven papermaking fabrics, photo-cured fabrics such as the previously discussed imprinting fabrics, or other fabrics, with exemplary repeating patterns including series of raised and depressed elements defining a repeating unit cell, the unit cell having a width of about any of the following values or greater: 3 millimeters (mm), 1 centimeter (cm), 5 cm, 10 cm, 20 cm, or substantially the cross-machine direction width of the non-woven tissue making fabric 30. The width of the unit cell may also be adapted to the finished width of the non-woven tissue making fabric 30. The length of the unit cell may be about any of the following values or greater: 3 millimeters (mm), 1 centimeter (cm), 5 cm, 10 cm, 20 cm, or about a percentage value of the machine direction length of the non-woven tissue making fabric 30 selected from 1%, 5%, 10%, 20%, 30%, 50%, or 100%. The length of the unit cell may also be adapted to the finished length of the non-woven tissue making fabric 30. It is understood that wherein the length of the unit cell is greater than the length of the non-woven tissue making fabric 30, and/or the tissue making fabric length is not an integer multiple of the unit cell length, there may be a discontinuity in the repeating pattern. In one embodiment, the unit cell is as great as or greater than either the machine direction length or the cross-direction width or both of the non-woven tissue making fabric 30.

Figure 4:
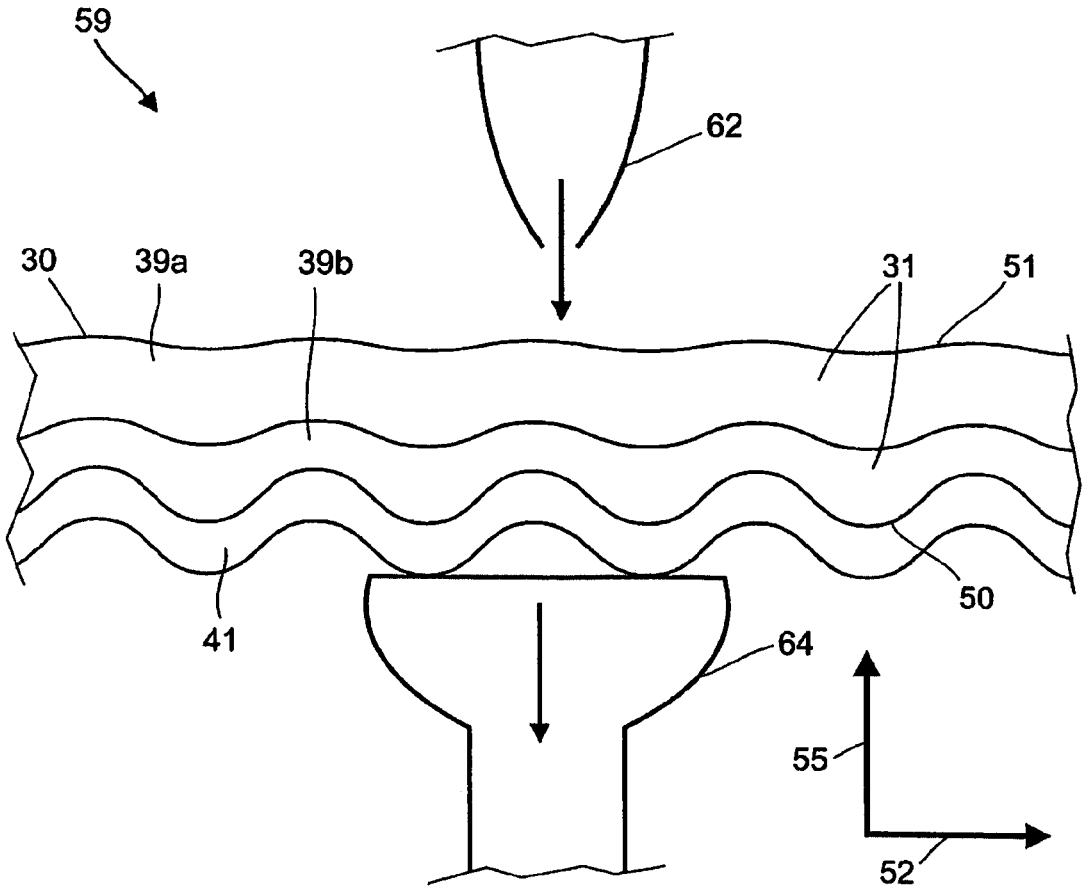
FIG. 4 is a schematic view of a molding section in a process for making a non-woven tissue making fabric according to one embodiment of the present invention.

FIG. 4 depicts a molding section 59 in a process for making a non-woven tissue making fabric 30, which is one embodiment for joining two superposed layers 39*a* and 39*b* of non-woven material 31 together to form the non-woven tissue making fabric 30, and for imparting texture to the non-woven tissue making fabric 30. Texture may be imparted by molding the non-woven tissue making fabric 30 (most particularly the layer 39*b* of the non-woven material 31 adjacent the carrier fabric 41) against the underlying carrier fabric 41, which may be a textured fabric with significant three-dimensional topography. An air knife 62 above the non-woven tissue making fabric 30 delivers heated air at an elevated pressure (stagnation pressure greater than atmospheric pressure) as the layers 39*a* and 39*b* of the non-woven material 31 and carrier fabric 41 travel in the machine direction 52. The heated air is pulled through the non-woven tissue making fabric 30 and the carrier fabric 41 with the optional assistance of a vacuum box 64 beneath the carrier fabric 41. The air knife 62 may deliver air heated to a sufficient temperature to soften thermoplastic material in one or both of the layers 39*a* and 39*b* of the non-woven material 31, permitting the layers 39*a* and 39*b* (most particularly the layer 39*b*) to conform better to the carrier fabric 41 and to assume its shape to a degree.

The non-woven tissue making fabric 30 has two surfaces, a "tissue machine contacting surface" 50 (the surface generally intended for contacting a tissue making machine during the tissue making process), and a "tissue contacting surface" 51 (the surface generally intended for contacting the tissue web during the tissue making process). In the embodiment shown in FIG. 4, the tissue contacting surface 51 of the non-woven tissue making fabric 30 is substantially more textured (more highly molded) than the tissue machine contacting surface 50, though in other embodiments, both the tissue contacting and tissue machine contacting surfaces 50 and 51, respectively, could have a similar degree of texture, or the tissue machine contacting surface 50 could be more highly textured. It is understood that the tissue machine contacting surface 50 may comprise the same or different pattern or texture than the tissue contacting surface 51 of the non-woven tissue making fabric 30.

The presence of sheath-core binder materials in non-woven materials 31 useful in the non-woven tissue making fabrics 30 may be helpful in molding, for the fusion of the sheath at elevated temperature followed by cooling of the non-woven material 31 results in fusion of the thermoplastic material of the sheath to better lock the molded structure in place. Likewise, a first portion of fibers in the non-woven material 31 may be thermoplastic with a lower melting point than a second portion of fibers in the non-woven material 31, such that the first portion of fibers may more easily melt and fuse the second portion of fibers together in the molded shape.

The molding section 59 may be installed in the apparatus 40 of FIG. 3, and may comprise an air knife of approximately the same width as the fabric strip 34, adapted to move in the cross-direction 53 to bond successive turns of the fabric strip 34 of non-woven material 31 to the underlying fabric strip 34 of the non-woven material 31 from the previous turn. The air knife may be of a width less than about the width of the fabric strip 34, a width about the same as the width of the fabric strip 34, or greater than the width of the fabric strip 34. The air knife may be of a width less than about the width of the finished non-woven tissue making fabric 30, a width about the same as the width of the finished non-woven tissue making fabric 30, or greater than the width of the finished non-woven tissue making fabric 30. In some embodiments of the present invention, the width of the fabric strip 34 may be the width of the finished non-woven tissue making fabric 30 or the width of the apparatus on which the non-woven tissue making fabric 30 is manufactured on.

Other principles for molding a web against a molding substrate are disclosed by Chen et al. in commonly owned application U.S. patent application Ser. No. 09/680,719, filed on Oct. 6, 2000 by Chen et al., herein incorporated by reference to the extent that it is non-contradictory herewith.

In another embodiment, the non-woven tissue making fabric 30 is not separated from the carrier fabric 41, but remains in contact with and preferably is bonded to the carrier fabric 41, such that the carrier fabric 41 becomes an integral part of the non-woven tissue making fabric 30, serving, for example, as a strength layer, wear-resistant layer, and/or texture layer in one or both of the tissue contacting surface 51 and the tissue machine contacting surface 50 of the non-woven tissue making fabric 30.

In another embodiment (not shown), the carrier fabric 41 may be used to receive nonwoven fibers as they are produced in a meltblown, spunbond, or other process, such that the non-woven material 31 is formed directly on a three-dimensional carrier fabric 41 to directly impart a three-dimensional structure to the non-woven material 31.

Figure 5:
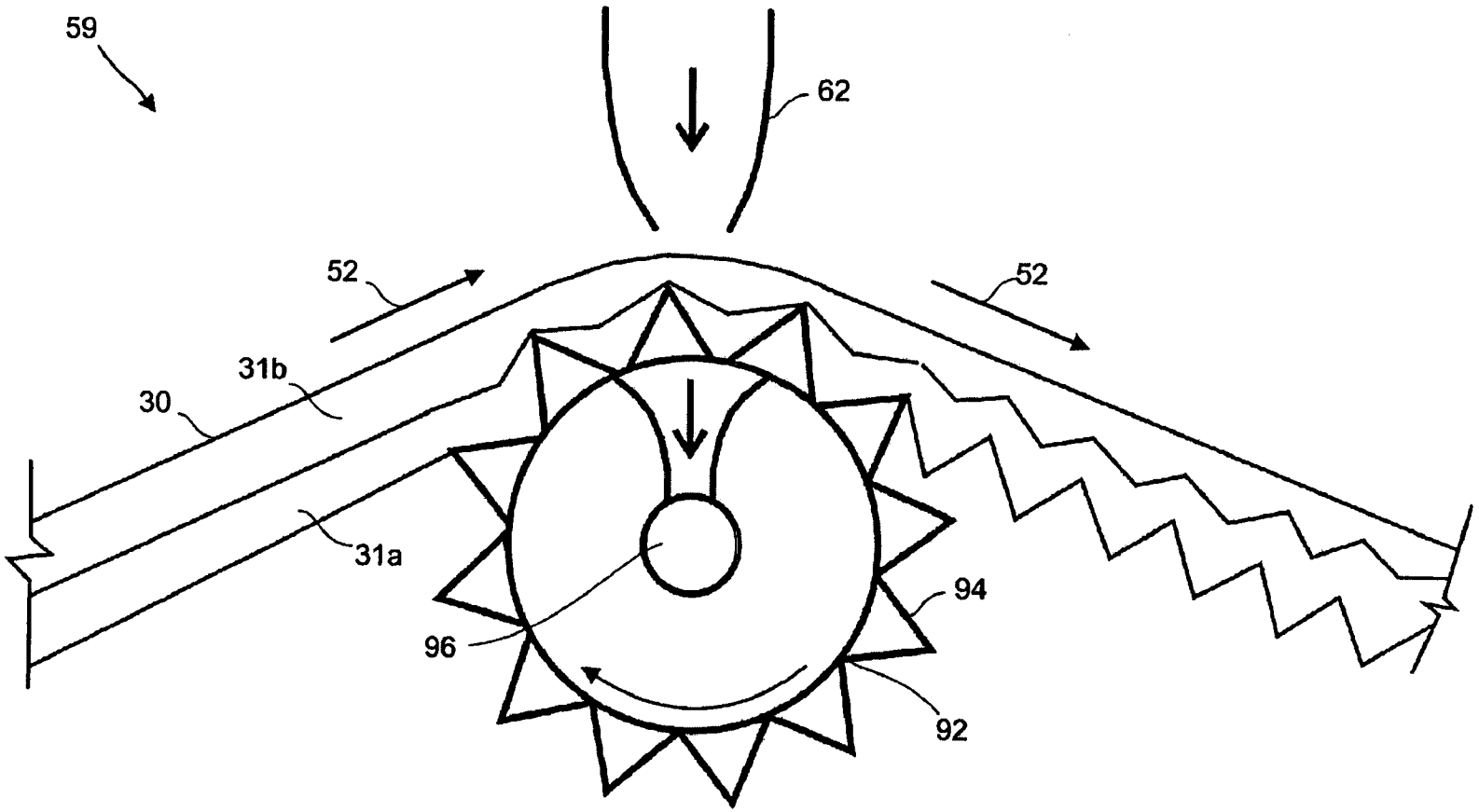
FIG. 5 is a schematic view of a rotating molding section in a process for making a non-woven tissue making fabric according to one embodiment of the present invention.

FIG. 5 depicts another embodiment of a molding section in which a two-ply non-woven tissue making fabric 30 passes over a rotating molding device 92 provided with raised molding elements 94 on the surface. The molding elements 94 as depicted are porous, comprising a material such as sintered metal, sintered ceramic, ceramic foam, or a finely drilled metal or plastic, allowing heated air to pass from an air knife 62 or other source, through the non-woven tissue making fabric 30 and into the rotating molding device 92 and to a vacuum source 96. Heated air from the air knife 62 allows thermoplastic material in at least one of the plies of non-woven material 31*a* and 31*b* to be thermally molded to conform at least in part to the surface of the rotating molding device 92. The molding elements 94 may be any shape, such as sine waves, triangles (as shown), square waves, irregular shapes, or other shapes. The rotating molding device 92 may be constructed as a suction roll to allow a narrow zone of vacuum to be applied to a fixed region as the roll rotates. The surface of the non-woven tissue making fabric 30 becomes substantially textured after contact with the rotating molding device 92, which may also be heated. The surface of the rotating device 92 may comprise discrete elements and/or may comprise a continuous shell. It is understood that the surface or shell of the rotating molding device 92 comprises a negative image of the desired shape or pattern of the tissue contacting surface 51 of the resulting non-woven tissue making fabric 30. In addition, the negative image on the surface of the rotating molding device 92 of the desired shape or pattern for the tissue contacting surface 51 of the non-woven tissue making fabric 30 may be adapted to vary the depth or intensity of the pattern on the tissue contacting surface 51 of the non-woven tissue making fabric 30. The pattern may be a continuous curvilinear, discrete elements, or a combination of both types.

It is understood that when a 2-ply non-woven tissue making fabric 30 is discussed herein, that such discussion may be applied to non-woven tissue making fabrics 30 comprising 2 or more plies. The non-woven tissue making fabric 30 may comprise about 1 ply or more. In other embodiments, the non-woven tissue making fabric 30 may comprise between about 1 ply and about 25 plies, more specifically between about 1 ply and about 10 plies.

Figure 6:
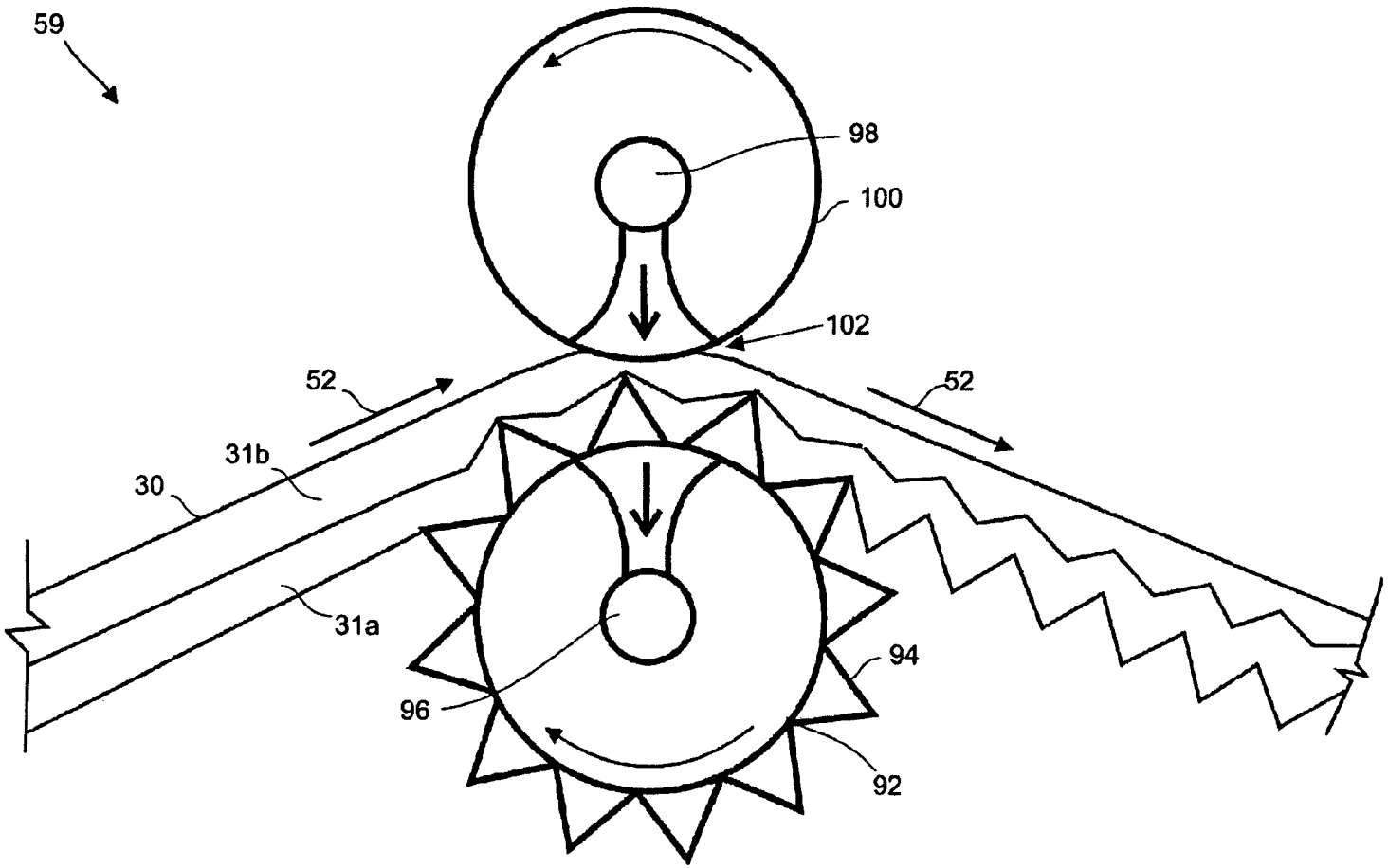
FIG. 6 is a schematic view of a rotating molding section in a process for making a two-ply non-woven tissue making fabric according to one embodiment of the present invention.

FIG. 6 depicts yet another embodiment of a molding section in which a two-ply non-woven tissue making fabric 30 passes over a rotating molding device 92 provided with raised molding elements 94 on the surface, similar to that shown in FIG. 5, but wherein the air is supplied from a pressurized source 98 connected to a rotating gas-pervious roll 100 through which the pressurized gas passes into a nip 102 between the rotating gas-pervious roll 100 and the counter-rotating molding device 92. Both the rotating gas-pervious roll 100 and the counter-rotating molding device 92 may be constructed as a suction roll to allow a narrow zone of vacuum to be applied to a fixed region as the gas-pervious roll 100 rotates. In the nip 102, heated air passes through the non-woven tissue making fabric 30 and mechanical pressure further conforms the non-woven tissue making fabric 30 to the shape of the rotating molding device 92 to improve the degree of texture imparted to the non-woven tissue making fabric 30. A one-sided texture is shown, but both sides of the non-woven tissue making fabric 30 may become molded. Enhanced two-sided molding may be achieved by using a textured rotating gas-pervious roll 100 with a texture that may be essentially a mirror image of the texture of the rotating molding device 92 to permit intermeshing of the textured surfaces of the rotating molding device 92 and the gas-pervious roll 100 in the nip 102. In an alternate embodiment, a gas pervious roll 100 may be fitted with a suitably textured surface to impart a texture to the tissue machine contacting surface 51 which is substantially independent of the texture on the tissue contacting surface 50 of the non-woven tissue making fabric 30.

Figure 7:
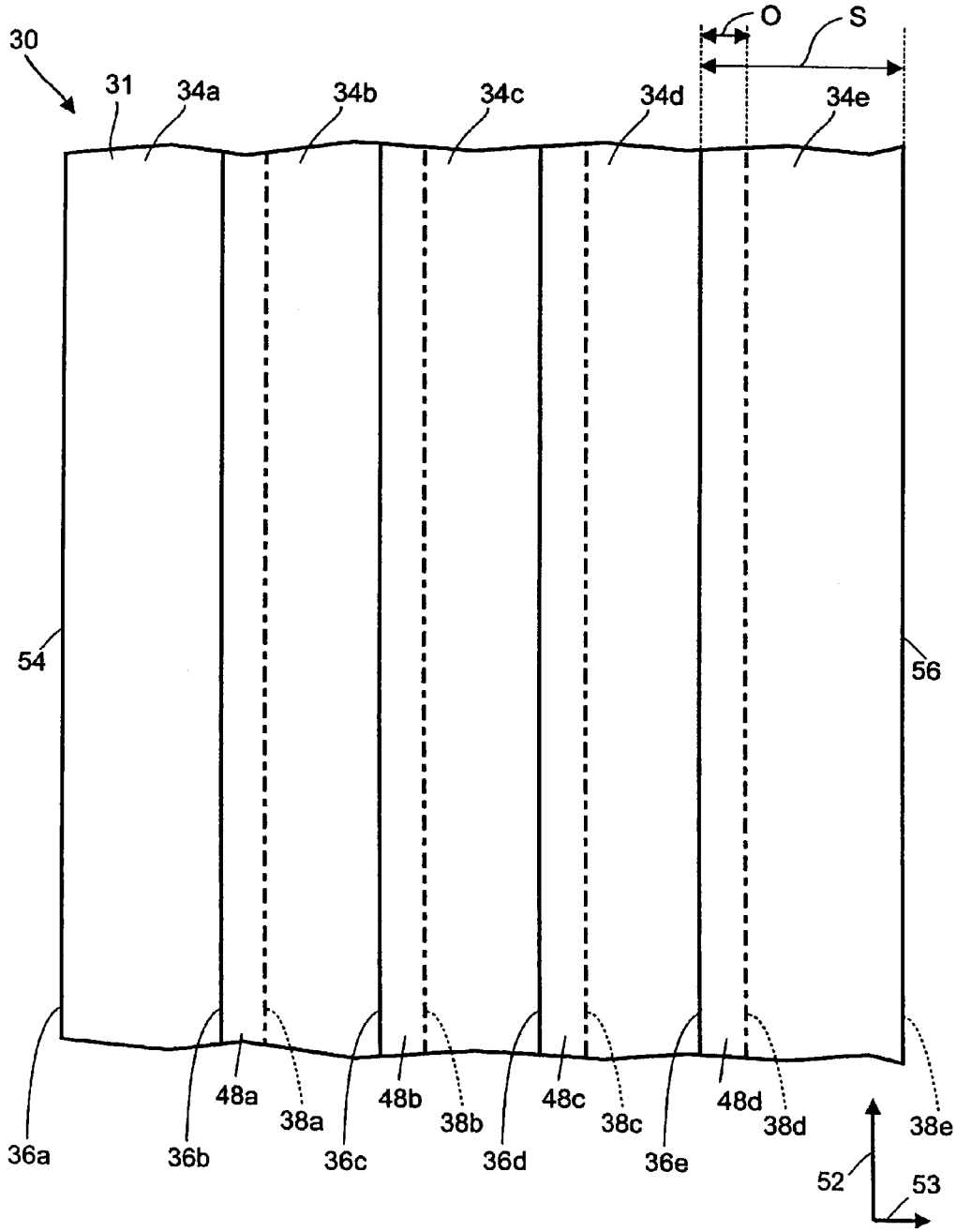
FIG. 7 is a schematic of a top view of a portion of a non-woven tissue making fabric according to the present invention having a plurality of fabric strips.

FIG. 7 depicts a top view of a portion of a non-woven tissue making fabric 30 according to the present invention. A plurality of fabric strips 34*a*-34*e*, are shown, substantially aligned with the machine direction 52 of the non-woven tissue making fabric 30. Each of the fabric strips 34*b* 34*e* overlaps a portion of the adjacent fabric strips 34*a* 34*d*, respectively, defining regions of overlap that are bonded to form seams 48*a*-48*d*. Each fabric strip 34*a*-34*e* has a first edge 36*a*-36*e*, respectively, and a second edge 38*a*-38*e*, respectively. The non-woven tissue making fabric 30 itself has a first side edge 54 and a second side edge 56. The seams 48*a*-48*d* may be spirally continuous, or may comprise a plurality of substantially parallel, discrete seams 48 formed by joining a plurality of discrete fabric strips 34 (which may be discrete continuous loops).

The width "O" of the overlap region is a fraction of the fabric strip width "S". The degree of overlap of the fabric strip 34 is the ratio O/S, which may vary from about 0 (abutting fabric strips 34 or sections of non-woven material 31) to about 1 (multiple plies of non-woven material 31 that are coextensive, at least in one dimension), or any value in between. For example, the degree of overlap may range from about 0 to any integral multiple of about 0.02 less than or equal to about 1.0 (e.g., from about 0 to about 0.64), or may range from any multiple of about 0.02 less than or equal to about 0.98 to a maximum value of about 1 (e.g., from about 0.64 to about 1), or may cover any subset of such ranges such as from about 0.06 to about 0.7, or from about 0.1 to about 0.5, or from about 0.1 to about 0.48. For example, the degree of overlap may be about 1 or less than about 1. In another embodiment, the degree of overlap may be about 0.66. In yet another embodiment of the present invention, the degree of overlap may be about 0.90.

Figure 8B:
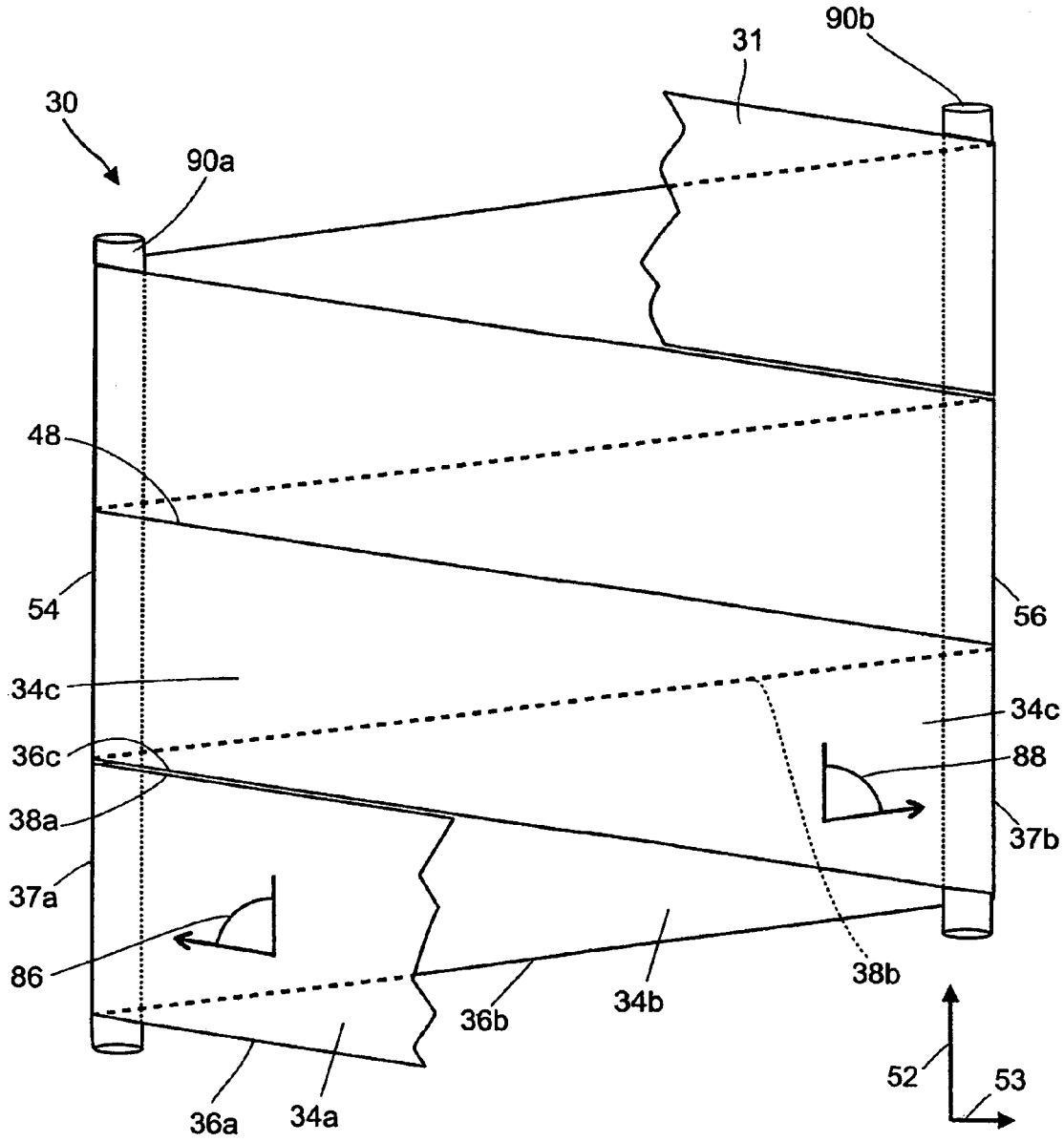

FIGS. 8A and 8B depict alternate embodiments in which a fabric strip 34 is wound in a plurality of turns to form a non-woven tissue making fabric 30, but wherein the fabric strip 34 is aligned at an acute angle substantially away from the machine direction 52 of the non-woven tissue making fabric 30. In the embodiment shown in FIG. 8A, a fabric strip 34 having a width is folded back upon itself repeatedly in what may be termed a "flattened helix." The first and second side edges 54 and 56 of the non-woven tissue making fabric 30 coincide with the folds of the fabric strip 34. A first section of the fabric strip 34*a* has a longitudinal axis at a first angle 86 relative to the machine direction 52 and reverses upon itself at a first fold 37*a*, continuing in a second section of the fabric strip 34*b* with its longitudinal axis at a second angle 88 relative to the machine direction 52, which then reverses upon itself at a second fold 37*b*, and so forth. The first edge 36*b* of the second section of the fabric strip 34*b* resides beneath the first section of the fabric strip 34*a*. The first edge 36*c* of the third section of the fabric strip 34*c* abuts the second edge 38*a* of the first section of the fabric strip 34*b*, and so forth. (In an alternate embodiment (not shown), the first edge 36*c* of the third section of the fabric strip 34*c* overlaps the second edge 38*a* of the first section of the fabric strip 34*b*, and so forth.)

The flattened helix structure of the non-woven tissue making fabric 30 provides a ply having two layers throughout the non-woven tissue making fabric 30. The abutting edges 36 and 38 of adjacent sections of the fabric strip 34 in a given layer define a spirally continuous seam 48 having a flattened helical form, with two sets of parallel regions at a first angle 86 and a second angle 88, respectively. (Other embodiments lacking the flattened helical structure may have seams 48 that are substantially parallel throughout the non-woven tissue making fabric 30, including seams 48 substantially aligned with or at an acute angle to the machine direction 52, or may also have a plurality of seams 48 aligned with a plurality of angles.)

The overlapping layers of the non-woven tissue making fabric 30 formed from the fabric strips 34 may be bonded together throughout the non-woven tissue making fabric 30 or primarily along the seam 48. Reinforcing layers may be added, as desired.

Figure 11:
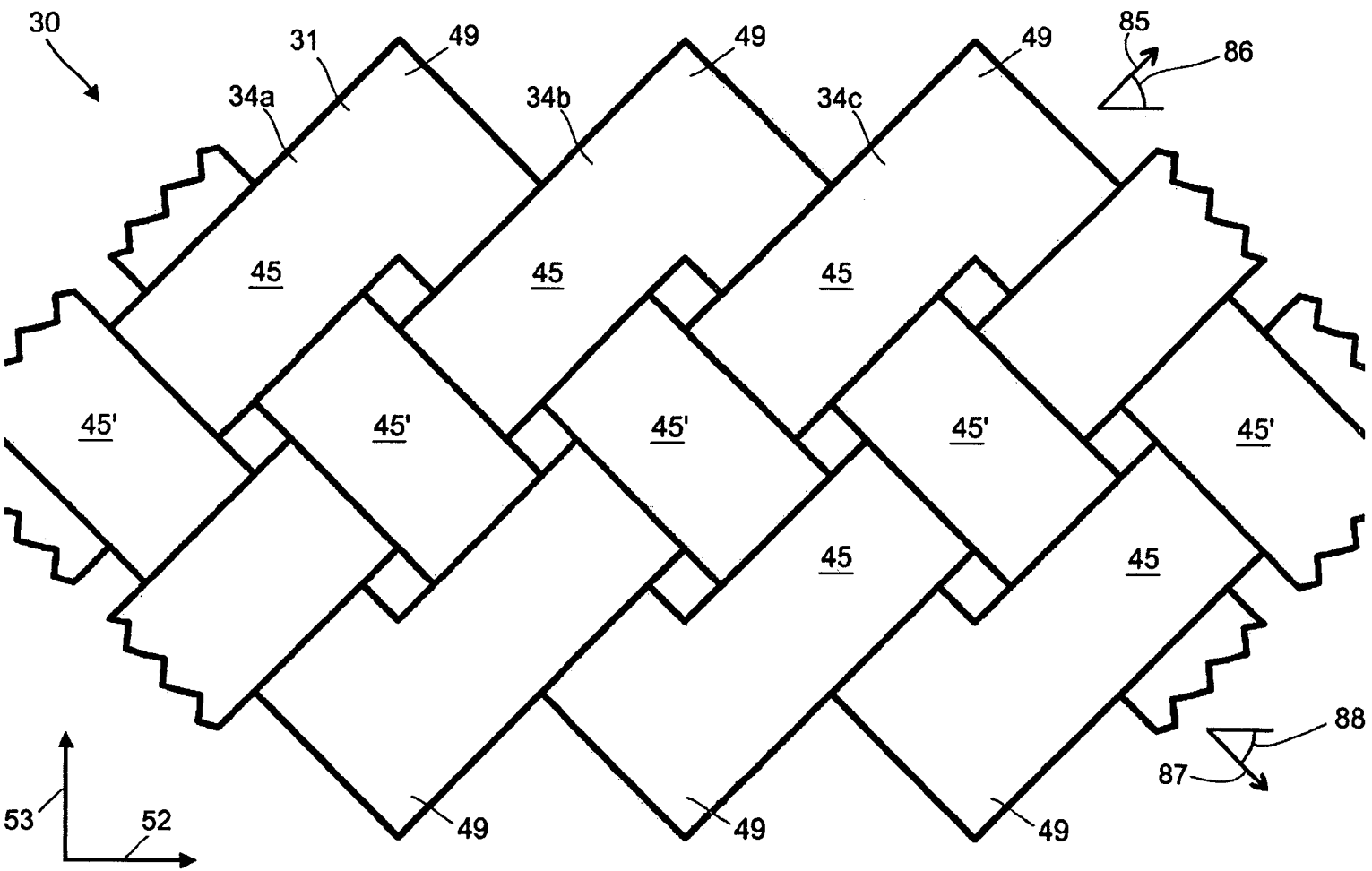
FIG. 11 is a schematic view of a non-woven tissue making fabric of another embodiment of the present invention.

In general, a single fabric strip 34 may provide more than one parallel section 34*a* and 34*c*, as can occur when a fabric strip 34 is folded back upon itself as shown in FIG. 8A or when a fabric strip 34 has a complex shape such as a zig-zags shape, as discussed hereafter in connection with FIG. 11. If a fabric strip 34 has a simple linear shape (e.g., an elongated rectangle), then the fabric strips 34 and sections of the fabric strips 34 are synonymous, otherwise a section such as the first section of the fabric strip 34*a* may be a subset of a fabric strip 34.

FIG. 8B depicts a non-woven tissue making fabric 30 similar to that of FIG. 8A but with reinforcing strips 90*a* and 90*b* added along the first and second side edges 54 and 56 of the non-woven tissue making fabric 30, between the two overlapping plies at the internal portion of the folds 37*a* and 37*b*, etc. The reinforcing strips 90*a* and 90*b* may be non-woven material, ropes, metal wires, fiberglass-reinforced bands, a polymeric, film, and the like, and may be joined by adhesive means, thermal bonding, ultrasonic bonding, or any other known means.

Figure 9:
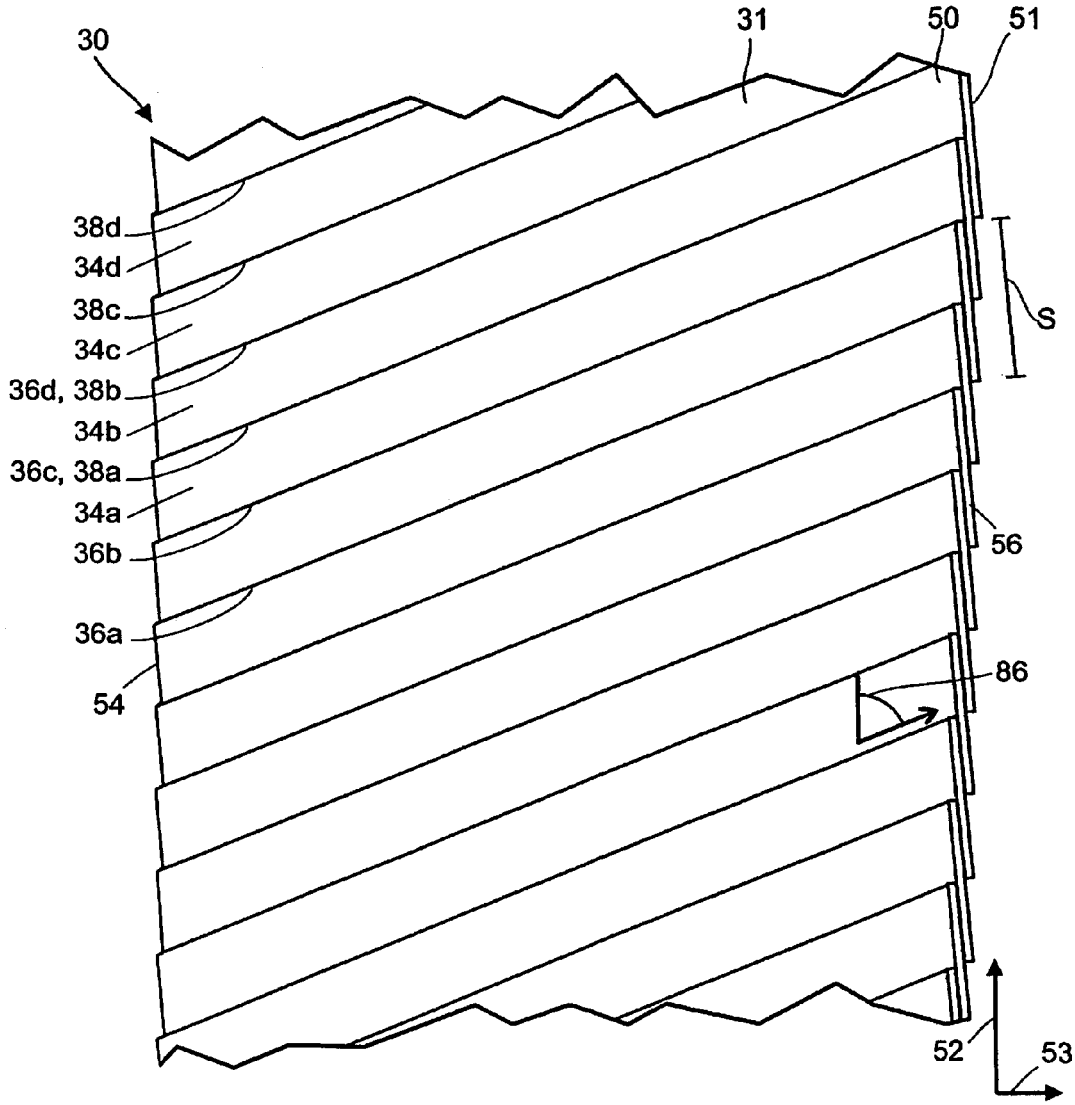
FIG. 9 is a schematic view of a non-woven tissue making fabric of another embodiment of the present invention.

FIG. 9 depicts a non-woven tissue making fabric 30 comprising a plurality of discrete fabric strips 34 having a strip width "S". The fabric strips 34*a*-34*e* (the 5 exemplary fabric strips 34 are numbered) lie at an acute angle 86 to the machine direction 52 of the non-woven tissue making fabric 30. Further, each fabric strip 34*a*-34*e* overlaps about 50% of the "S" width of each neighboring fabric strip 34*a*-34*e* (the degree of overlap in this example would be about 0.5), such that the non-woven tissue making fabric 30 has a basis weight equal to approximately twice the basis weight of an individual fabric strip 34*a*-34*e*.

The non-woven tissue making fabric 30 has a tissue machine contacting surface 50 and a tissue contacting surface 51, which in the embodiment shown, may have substantially the same topography, unless the individual fabric strips 34 have a two-sided texture (wherein one side is more textured than the other side). The fabric strips 34 need not all be comprised of the same non-woven material 31, but may be taken from a plurality of non-woven materials 31. For example, the fabric strips 34 may alternate between a first and second non-woven material 31. Additional material (not shown) may be added at the first and second side edges 54 and 56 to further reinforce the non-woven tissue making fabric 30.

In other embodiments (not shown), the discrete fabric strips 34 may have a variety of widths, such as fabric strips 34 selected from two or more widths "S". In another embodiment (not shown), the width of the fabric strips 34 varies with position, such as where the fabric strips 34 have sinusoidal edges that periodically increase and decrease the width of the fabric strip 34.

Figure 10:
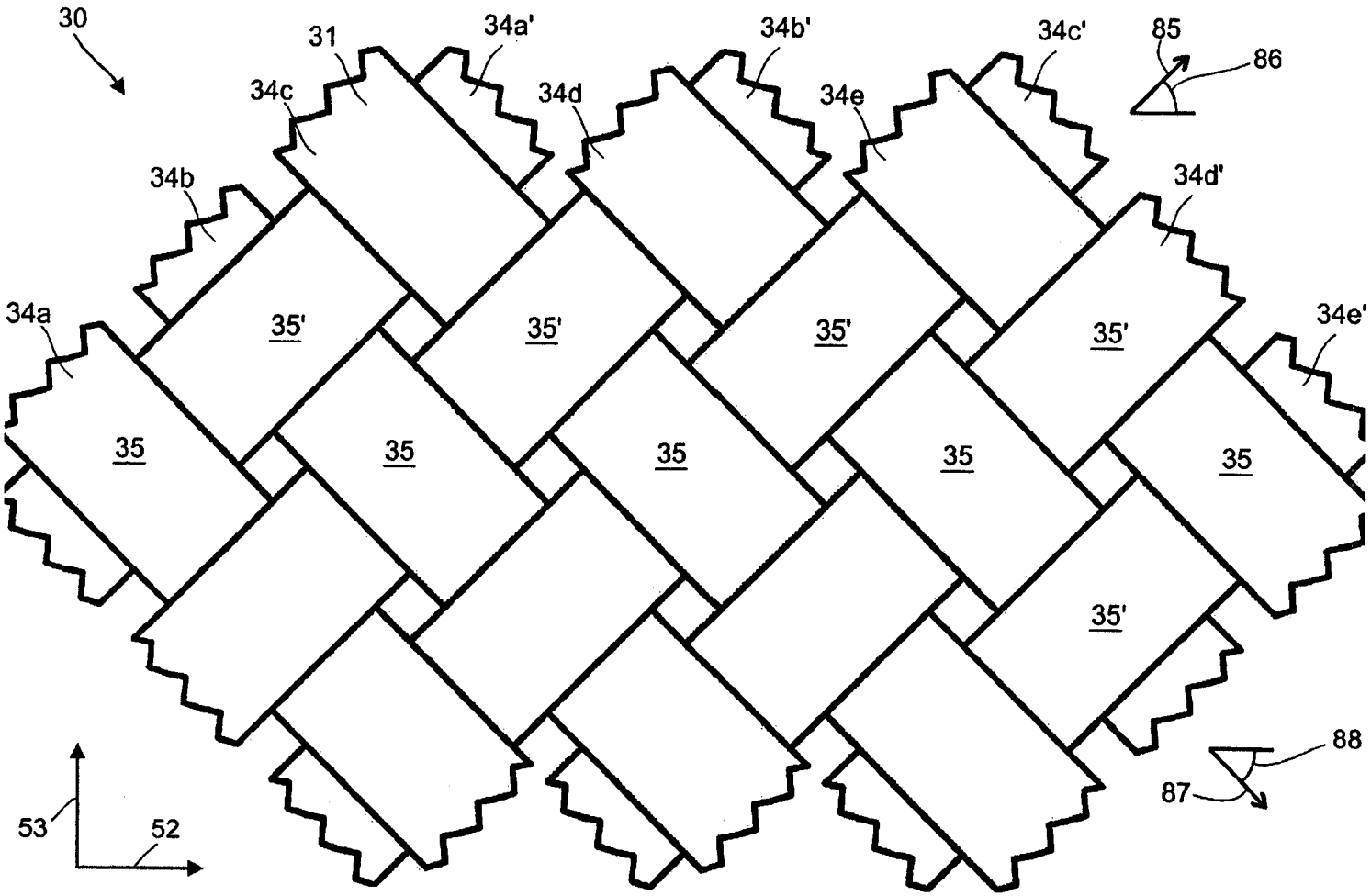
FIG. 10 is a schematic view of a non-woven tissue making fabric of another embodiment of the present invention.

FIG. 10 shows a non-woven tissue making fabric 30 having a plurality of fabric strips 34 that are interwoven to form an interwoven non-woven tissue making fabric 30. The piece of the non-woven tissue making fabric 30 shown has interwoven fabric strips 34 comprising a first group 35 of parallel strips 34*a*-34*e* aligned in a first direction 87 at an acute angle 88 with the machine direction 52, and a second group 35' of parallel fabric strips 34*a*'-34*e*' aligned in a second direction 85 at an acute angle 86 with the machine direction 52, and interwoven such that any fabric strip 34 successively passes over and under other fabric strips 34 in the non-woven tissue making fabric 30. While the interwoven arrangement of fabric strips 34 may provide an interlocking structure, the fabric strips 34 may be bonded together in regions where one fabric strip 34 is above or below another fabric strip 34, or along the first and second edges 36 and 38 of adjoining parallel fabric strips 34, or both, to increase the mechanical stability and durability of the non-woven tissue making fabric 30.

FIG. 11 depicts another interlocking non-woven tissue making fabric 30 comprising interlocking fabric strips 34, wherein at least one fabric strip 34 is a non-straight strip comprising at least two portions 45 and 45' wherein the first portion 45 is aligned with a first direction 85 at an acute angle 86 with the machine direction 52, and the second portion 45' is aligned with a second direction 87 at an acute angle 88 with the machine direction 52. Within a transition region 49, the first portion 45 is joined with the second portion 45'. The transition region 49 may be a simple elbow as depicted, or may be curved or any other suitable shape. The first and second portions 45 and 45' need not be linear but may be sinusoidal or have other shapes while extending substantially in the first and second directions 85 and 87, respectively. As depicted, three non-straight fabric strips 34*a*-34*c* are shown, each with linear first and second portions 45 and 45'. The non-straight fabric strips 34*a*-34*c* are interwoven such that the fabric strips 34 successively pass over and under each other in the non-woven tissue making fabric 30. While the interwoven arrangement of fabric strips 34 may provide an interlocking structure, the fabric strips 34 may further be bonded together in regions where one fabric strip 34 is above or below another fabric strip 34, or along the first and second edges 36 and 38 of adjoining parallel portions 45 and 45', or both, to increase the mechanical stability and durability of the non-woven tissue making fabric 30.

More complex weave patterns may be contemplated other than the simple ones shown in FIGS. 10 and 11.

Figure 12:
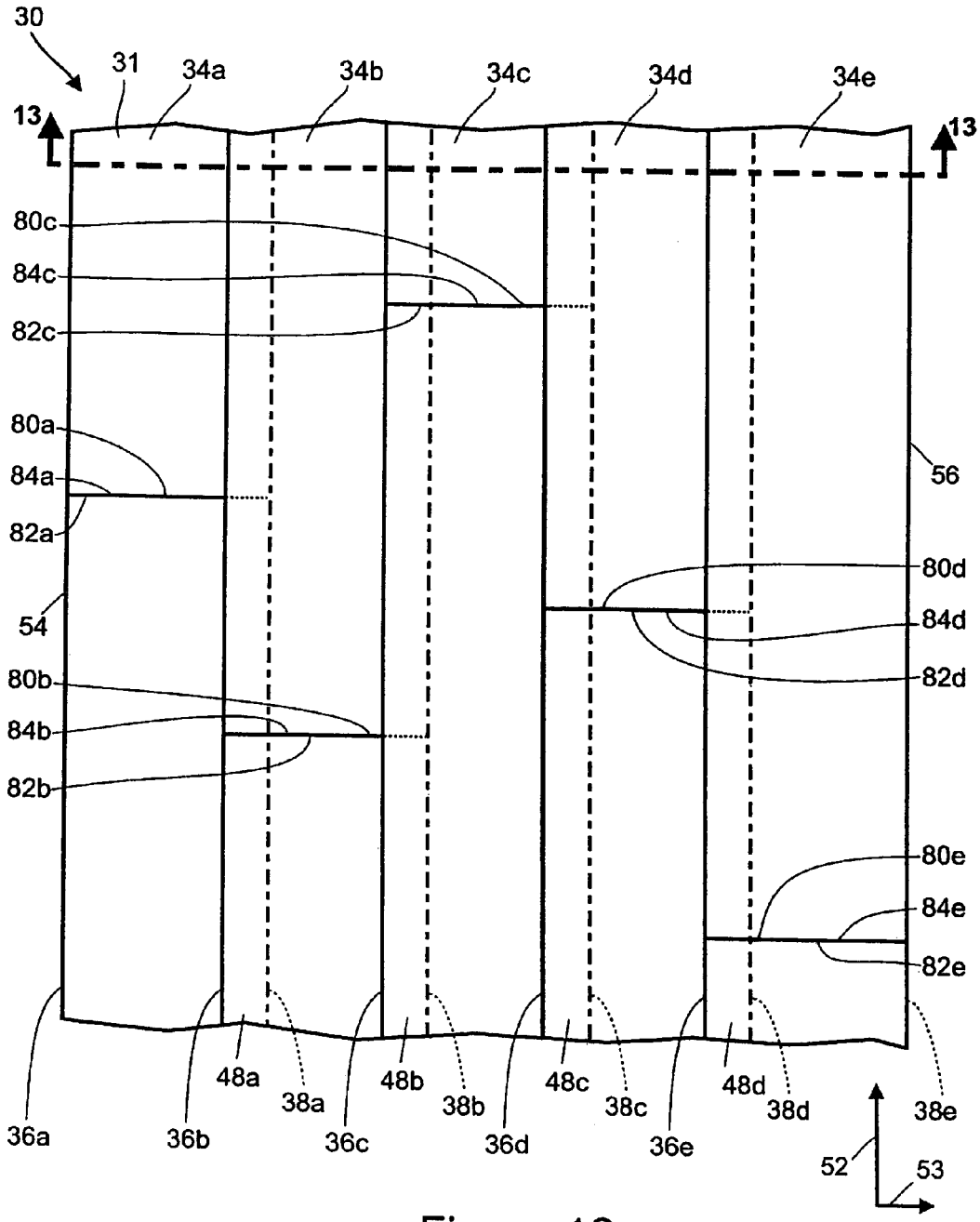
FIG. 12 is a schematic view of a non-woven tissue making fabric having discrete parallel fabric strips of non-woven material.

FIG. 12, which is a variation of the embodiment shown in FIG. 7, depicts a portion of another embodiment of a non-woven tissue making fabric 30 according to the present invention, formed into an endless loop, in which discrete parallel fabric strips 34 of non-woven material 31 have first ends 80 and second ends 82 that are joined together to form a traverse fabric seam 84, while the first and second edges 36 and 38 of the fabric strips 34 are joined (shown here as overlapping) to form a longitudinal seam 48. Shown are five fabric strips 34*a*-34*e*, each with respective first ends 80*a*-80*e* and second ends 82*a*-82*e* that are brought together to form the fabric seam 84 comprising staggered portions of the fabric seam 84*a*-84*e*. The first and second ends 80*a*-80*e* and 82*a*-82*e*, respectively, maybe fastened in a longitudinally overlapping or abutting fashion (an abutting fashion is depicted) and bonded together by any means known in the art as discussed herein to form the fabric seam 84 as were discussed in the formation of the seam 48. The fabric seam 84 may be in a straight line or may be in a staggered line, as shown, in the cross-machine direction.

The first and second ends 80 and 82 of the fabric strips 34 are shown to be straight cross-directional cuts, but this need not be the case in other embodiments. The first and second ends 80 and 82 may be cut at any angle or multiple angles to the cross direction 53 and may be nonlinear, such as cuts having dovetail, curvilinear, or triangular characteristics.

Figure 13:
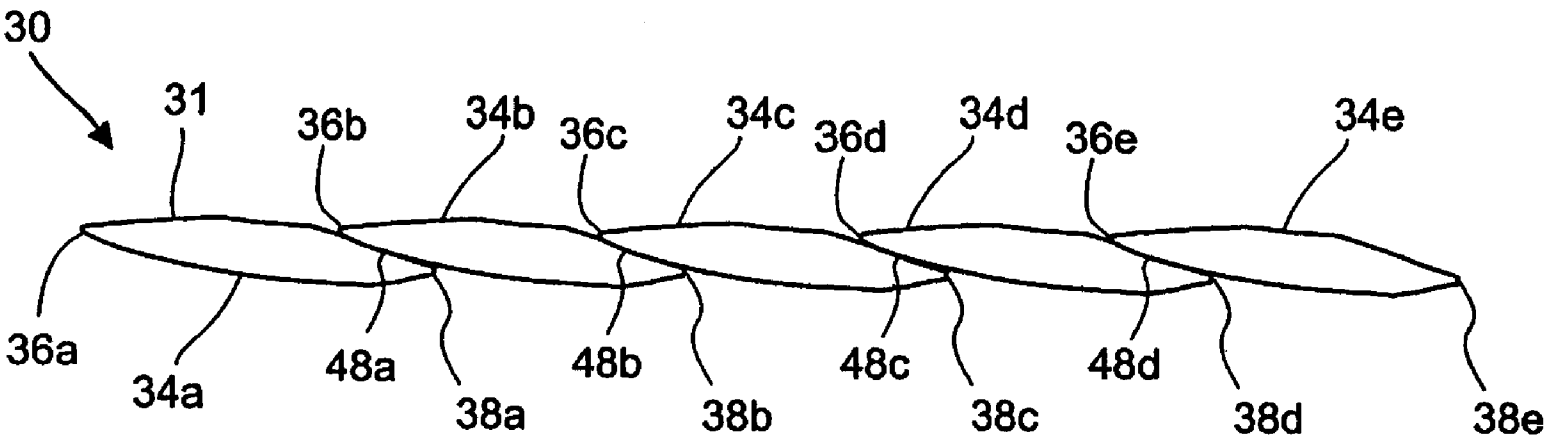
FIG. 13 is a cross-sectional view of the non-woven tissue making fabric of FIG. 12, taken as indicated by line 13-13 in FIG. 12.

FIG. 13 depicts a cross-sectional profile of the non-woven tissue making fabric 30 taken along line 13-13 in FIG. 12. Shown are the fabric strips 34*a*-34*e*, depicted with tapered thickness profiles such that the overlapping regions in the vicinity of the seams 48*a*-48*d* have a thickness not significantly greater than in non-overlapping regions, such that the overall non-woven tissue making fabric 30 has a relatively uniform thickness along most of the cross-sectional profile.

Test Methods

"Overall Surface Depth"

A three-dimensional tissue making fabric or tissue web may have significant variation in surface elevation due to its structure. As used herein, this elevation difference is expressed as the "Overall Surface Depth." The non-woven tissue making fabrics and tissue webs of the present invention may possess three-dimensionality and may have an Overall Surface Depth of about 0.1 millimeter (mm) or greater, more specifically about 0.3 mm or greater, still more specifically about 0.4 mm or greater, still more specifically about 0.5 mm or greater, and still more specifically from about 0.4 mm to about 0.8 mm.

A suitable method for measurement of Overall Surface Depth is moiré interferometry, which permits accurate measurement without deformation of the surface. For reference to the materials of the present invention, surface topography should be measured using a computer-controlled white-light field-shifted moiré interferometer with about a 38 mm field of view. The principles of a useful implementation of such a system are described in Bieman et al. (L. Bieman, K. Harding, and A. Boehnlein, "Absolute Measurement Using Field-Shifted Moiré," SPIE Optical Conference Proceedings, Vol. 1614, pp. 259-264, 1991). A suitable commercial instrument for moiréinterferometry is the CADEYES® interferometer produced by Medar, Inc. (Farmington Hills, Mich.), constructed for a nominal 35-mm field of view, but with an actual 38-mm field-of-view (a field of view within the range of 37 to 39.5 mm is adequate). The CADEYES® system uses white light which is projected through a grid to project fine black lines onto the sample surface. The sample surface is viewed through a similar grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera.

In the CADEYES moiré interferometry system, each pixel in the CCD video image is said to belong to a moiré fringe that is associated with a particular height range. The method of field-shifting, as described by Bieman et al. (L. Bieman, K. Harding, and A. Boehnlein, "Absolute Measurement Using Field-Shifted Moiré," SPIE Optical Conference Proceedings, Vol. 1614, pp. 259-264, 1991) and as originally patented by Boehnlein (U.S. Pat. No. 5,069,548, issued on Dec. 3, 1991, the disclosure of which is herein incorporated by reference to the extent that it is non-contradictory herewith), is used to identify the fringe number for each point in the video image (indicating which fringe a point belongs to). The fringe number is needed to determine the absolute height at the measurement point relative to a reference plane. A field-shifting technique (sometimes termed phase-shifting in the art) is also used for sub-fringe analysis (accurate determination of the height of the measurement point within the height range occupied by its fringe). These field-shifting methods coupled with a camera-based interferometry approach allows accurate and rapid absolute height measurement, permitting measurement to be made in spite of possible height discontinuities in the surface. The technique allows absolute height of each of the roughly 250,000 discrete points (pixels) on the sample surface to be obtained, if suitable optics, video hardware, data acquisition equipment, and software are used that incorporates the principles of moiré interferometry with field-shifting. Each point measured has a resolution of approximately 1.5 microns in its height measurement.

The computerized interferometer system is used to acquire topographical data and then to generate a grayscale image of the topographical data, said image to be hereinafter called "the height map." The height map is displayed on a computer monitor, typically in 256 shades of gray and is quantitatively based on the topographical data obtained for the sample being measured. The resulting height map for the 38-mm square measurement area should contain approximately 250,000 data points corresponding to approximately 500 pixels in both the horizontal and vertical directions of the displayed height map. The pixel dimensions of the height map are based on a 512×512 CCD camera which provides images of moiré patterns on the sample which can be analyzed by computer software. Each pixel in the height map represents a height measurement at the corresponding x- and y-location on the sample. In the recommended system, each pixel has a width of approximately 70 microns, i.e. represents a region on the sample surface about 70 microns long in both orthogonal in-plane directions). This level of resolution prevents single fibers projecting above the surface from having a significant effect on the surface height measurement. The z-direction height measurement should have a nominal accuracy of less than 2 microns and a z-direction range of at least 1.5 mm.

The moiré interferometer system, once installed and factory calibrated to provide the accuracy and z-direction range stated above, can provide accurate topographical data for materials such as paper towels. (The accuracy of factory calibration may be confirmed by performing measurements on surfaces with known dimensions.) Tests are performed in a room under Tappi conditions (73° F., 50% relative humidity). The sample must be placed flat on a surface lying aligned or nearly aligned with the measurement plane of the instrument and should be at such a height that both the lowest and highest regions of interest are within the measurement region of the instrument.

Once properly placed, data acquisition is initiated using CADEYES® PC software and a height map of 250,000 data points is acquired and displayed, typically within 30 seconds from the time data acquisition was initiated. (Using the CADEYES® system, the "contrast threshold level" for noise rejection is set to 1, providing some noise rejection without excessive rejection of data points.) Data reduction and display are achieved using CADEYES® software for PCs, which incorporates a customizable interface based on Microsoft Visual Basic Professional for Windows (version 3.0), running under Windows 3.1. The Visual Basic interface allows users to add custom analysis tools.

The height map of the topographical data can then be used by those skilled in the art to measure the typical peak to valley depth of a surface. A simple method of doing this is to extract two-dimensional height profiles from lines drawn on the topographical height map which pass through the highest and lowest areas of unit cells when there are repeating structures. These height profiles may then be analyzed for the peak to valley distance, if the profiles are taken from a sheet or portion of the sheet that was lying relatively flat when measured. To eliminate the effect of occasional optical noise and possible outliers, the highest 10% and the lowest 10% of the profile should be excluded, and the height range of the remaining points is taken as the surface depth. Technically, the procedure requires calculating the variable which we term "P10," defined at the height difference between the 10% and 90% material lines, with the concept of material lines being well known in the art, as explained by L. Mummery, in Surface Texture Analysis: The Handbook, Hommelwerke GmbH, Mühlhausen, Germany, 1990. In this approach, the surface is viewed as a transition from air to material. For a given profile, taken from a flat-lying sheet, the greatest height at which the surface begins—the height of the highest peak—is the elevation of the "0% reference line" or the "0% material line," meaning that 0% of the length of the horizontal line at that height is occupied by material. Along the horizontal line passing through the lowest point of the profile, 100% of the line is occupied by material, making that line the "100% material line." In between the 0% and 100% material lines (between the maximum and minimum points of the profile), the fraction of horizontal line length occupied by material will increase monotonically as the line elevation is decreased. The material ratio curve gives the relationship between material fraction along a horizontal line passing through the profile and the height of the line. The material ratio curve is also the cumulative height distribution of a profile. (A more accurate term might be "material fraction curve.")

Once the material ratio curve is established, the curve is used to define a characteristic peak height of the profile. The P10 "typical peak-to-valley height" parameter is defined as the difference between the heights of the 10% material line and the 90% material line. One advantage of this parameter is that outliers or unusual excursions from the typical profile structure have little impact on the P10 height. The units of P10 are mm. The Overall Surface Depth of a material is reported as the P10 surface depth value for profile lines encompassing the height extremes of the typical unit cell of that surface.

Overall Surface Depth measurements in tissue should exclude large-scale structures such as pleats or folds which do not reflect the three-dimensional nature of the original basesheet itself. It is recognized that sheet topography may be reduced by calendering and other operations which affect the entire basesheet. Overall Surface Depth measurement can be appropriately performed on a calendered basesheet.

Overall Surface Depth may be measured across sections of a fabric or paper web that are free of apertures, such that the profiles being considered pass exclusively over solid matter along the upper surface of the fabric or paper web.

EXAMPLES

Example 1

In order to further illustrate the non-woven tissue making fabrics of the present invention, a laminated two-layer non-woven tissue making fabric was produced with a three-dimensional topography. The nonwoven base fabric comprised a spunbond web made from bi-component fibers with a concentric sheath-core structure. The sheath material comprised Crystar® 5029 Polyethylene Terephthalate (PET) polyester resin (The DuPont Company, Old Hickory, Tenn., USA). The core material comprised HiPERTUF® 92004 Polyethylene Naphthalate (PEN) polyester resin (M&G Polymers USA LLC, Houston, Tex., USA). The sheath to core ratio was about 1:1 by weight. A bicomponent spunbond pilot line shown was used with a forming head having 88 holes per inch of face width, the holes having a diameter of 1.35 mm holes. The polymer was pre-dried overnight in polymer dryers at about 320° F., then extruded at a pack temperature of about 600° F. at a pack pressure of about 980 psig for the core and about 770 psig for the sheath, with a polymer flow rate of about 4 grams per hold per minute. The spin line length was about 50 inches. The quench air was provided at about 4.5 psig and a temperature of about 155° F. The fiber draw unit operated at ambient temperature and a pressure of about 4 psig. The forming height (height above the forming wire) was about 12.5 inches. The forming wire speed was about 65 fpm. Bonding was achieved with a hot air knife operating at pressure of about 2.5 psig and a temperature of about 300° F. at about 2 inches above the forming wire.

The resulting non-woven fabric had a fiber diameter of about 33 microns, a basis weight of about 100 grams per square meter (gsm), and air permeability of about 630 cubic feet per minute (CFM), and a maximum extensional stiffness of about 96 pli.

Figure 14:
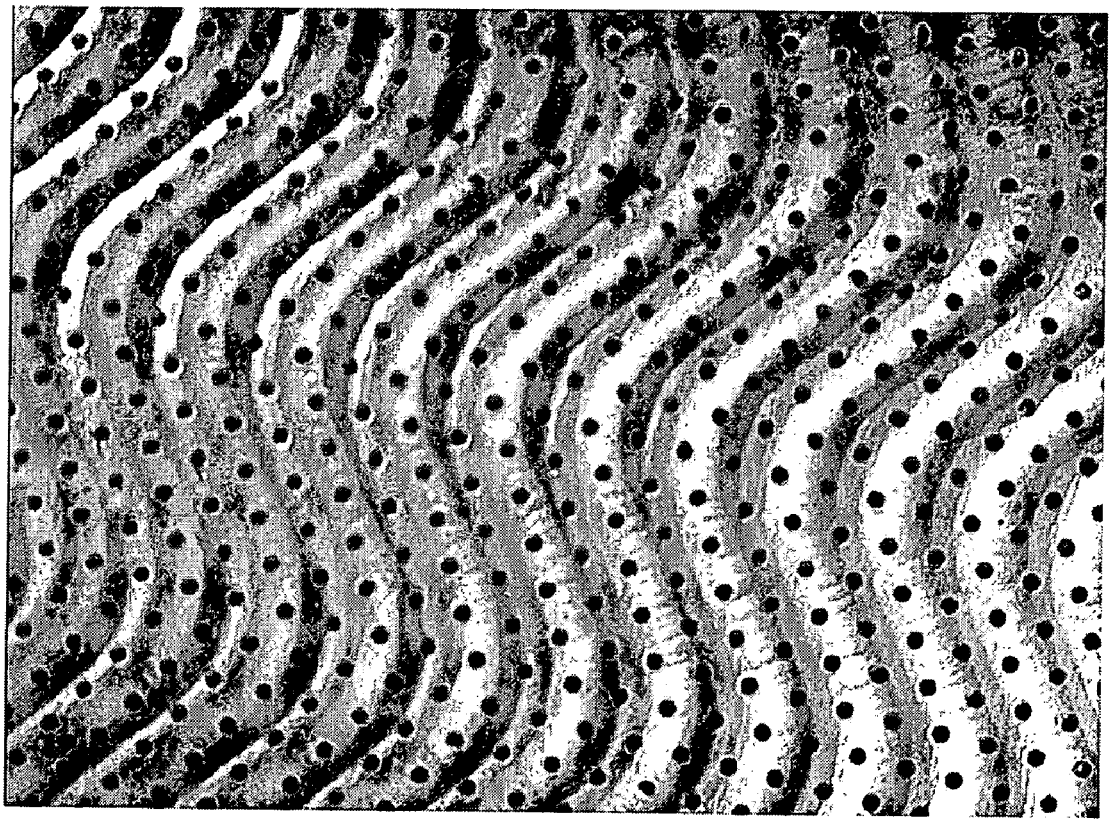
FIG. 14 is a photograph of a three-dimensional drilled metal plate used to mold a section of a non-woven tissue making fabric according to the present invention.

For molding of the nonwoven fabric into a three-dimensional fabric, two porous, three-dimensional metal plates were prepared from 2-mm thick aluminum discs 139 mm in diameter. First and second three-dimensional plates were prepared from two aluminum disc by machine-controlled drilling to selectively remove material as specified by a CAD drawing. A sinusoidal pattern was created for plates. In the first plate, the channels were specified to be about 0.035 inches (0.889 mm) deep with six channels per inch in the cross-direction. A photograph of the resulting molding plate is shown in FIG. 14, showing the sinusoidal channels (depressed regions), with spaced apart holes providing passageways for gas flow. The holes are 0.030-inch diameter holes spaced at 12 per inch. The machined pattern and the holes were restricted to a circular region about 98 mm in diameter centered in a slightly larger circular plate about 100 mm in diameter. A second metal plate was also machined with a similar geometry but with 0.015-inch (0.38 mm) deep channels specified, spaced at 14 per inch. The photograph in FIG. 14 has dimensions of about 33 mm by about 44 mm.

Figure 15:
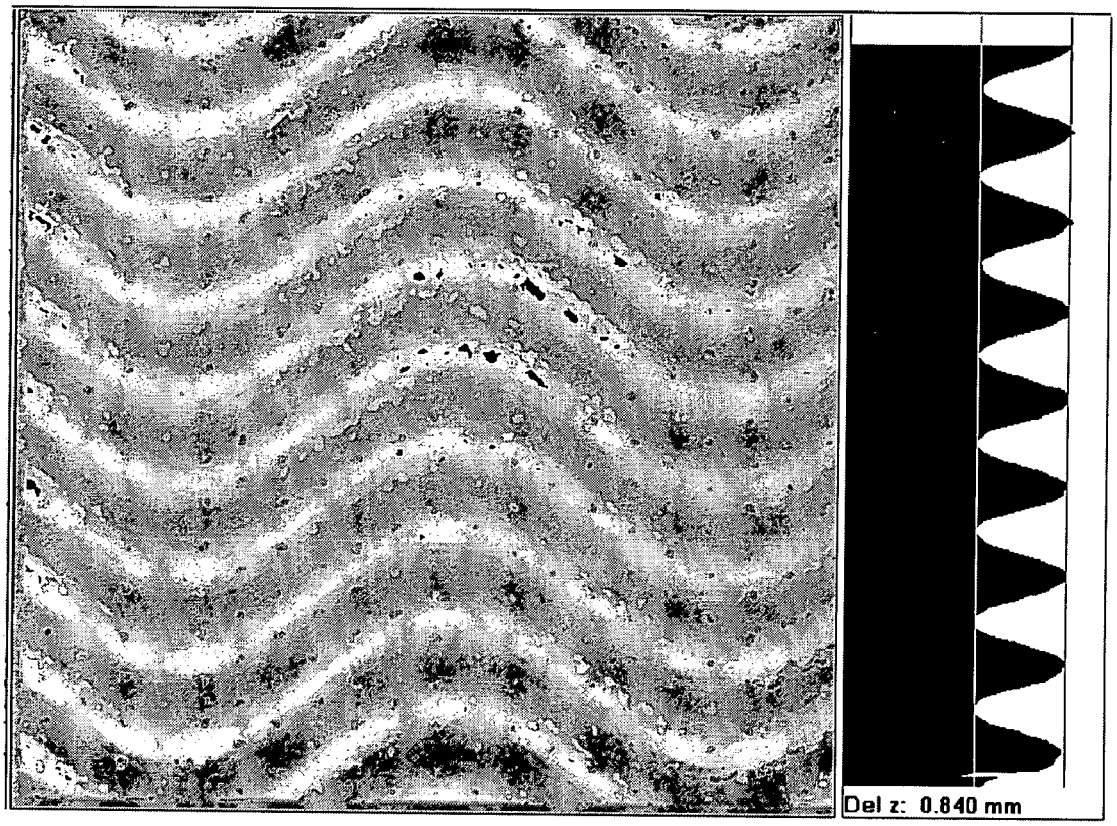
FIG. 15 is a screen shot showing a topographic height map of a portion of the first metal plate and a characteristic profile extracted from the height map.

FIG. 15 is a screen shot from software used with the CADEYES moiré interferometry tool showing height map of a portion of the first metal plate, taken with the 38-mm field of view CADEYES system. The higher regions appear lighter in color than the lower regions. The holes to permit air flow appear as spots of optical noise in the height map. A profile is displayed on the right hand side of the figure which corresponds to the height measurements along a line (not shown) selected in the vertical direction (top to bottom) of the height map; the line did not pass through any of the regions corresponding to holes on the plate. The peak-to-valley height from the CADEYES measurement is about 0.84 mm, slightly less than the specified value.

Figure 16:
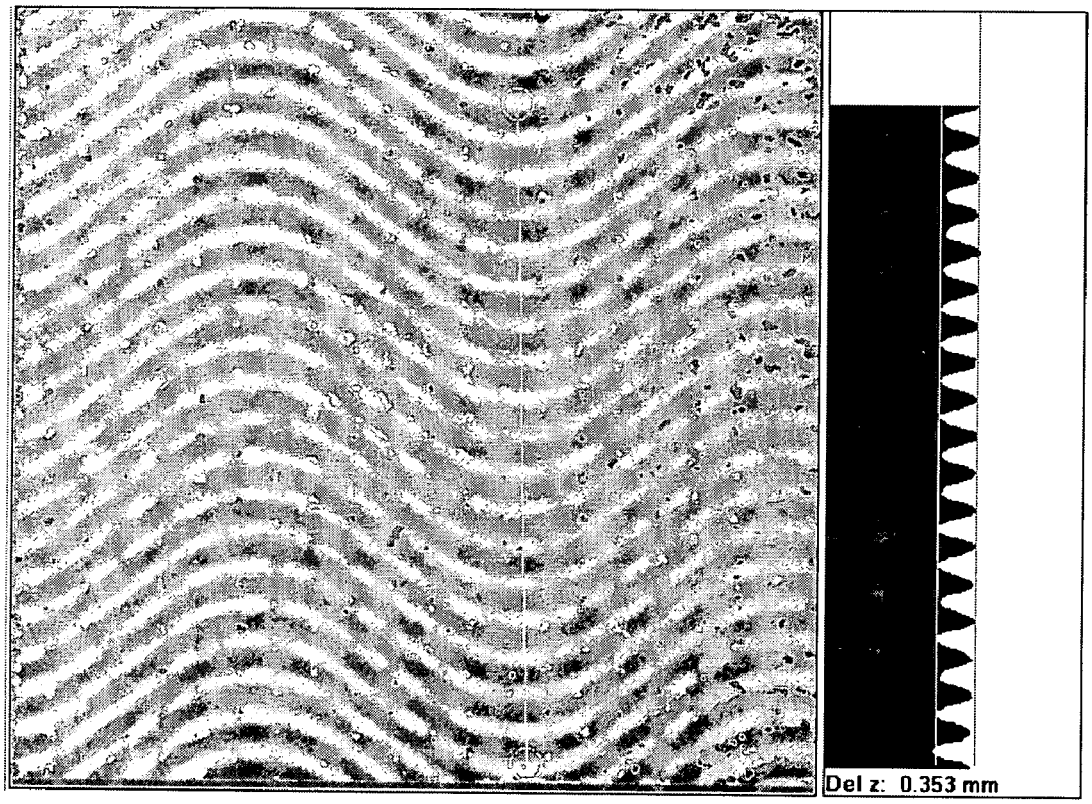
FIG. 16 is a screen shot showing a topographic height map of the first metal plate and a characteristic profile extracted from the height map.

FIG. 16 is another screen shot showing a topographical height map of a portion of the second three-dimensional plate also showing a profile line extracted from the a line along the height map (indicated on the height map as a light line terminated with circles) the topography of the channels. Optical noise occurs in several regions, not just over holes, possibly due to the shiny nature of the metal surface that posed difficulties for surface topography measurements in some regions.

One or more plies of the non-woven web cut into a disc with a diameter of 140 mm could be molded against the three-dimensional plate by holding the disc against the three-dimensional plate with an opposing flat backing plate, the backing plate having holes drilled with the same size and spacing as in the three-dimensional plate. Metal rings with an outer diameter of 139 mm and an inner diameter of about 101 mm and joined with adjustable screws formed a holder for the three-dimensional plate, a non-woven disc, and the flat backing plate. Heated air from a hot air gun was applied through a tube about 100 mm in diameter with an air velocity of about 1 m/s. The tube terminated with the flat backing plate held in place by the assembly of rings. Hot air passed through the backing plate, into the non-woven web, and then out through the holes of the three-dimensional plate. Inlet air temperature was controlled by adjusting the power setting on the heated air gun, with air temperature being measured after the air gun and prior to the backing plate by a thermocouple. The inlet air temperature was initially measured at 450° F., then was gradually increased over a period of 25 minutes to a peak temperature of 525° F., and the peak temperature was maintained for 10 minutes. Another thermocouple measured the air temperature after passing through the metal plates and the non-woven laminated. By the time that the inlet air temperature has reached about 525° F. the outlet air temperature has reached between about 200° F. and about 250° F. However, after ten minutes, the outlet air temperature had climbed gradually to about 275° F. The hot air gun was then turned off and room-temperature air was passed through the system to cool off the plates and the non-woven laminate.

Two plies of the non-woven material were superimposed and heated as described above while being pressed lightly between the flat backing plate and the first three-dimensional plate, resulting in a bonded and molded two-ply laminate having three-dimensional surface and a relatively flat surface. The Air Permeability of the molded two-ply fabric was about 289 CFM (the mean of three samples, with a standard deviation of 45 CFM).

Figure 17:
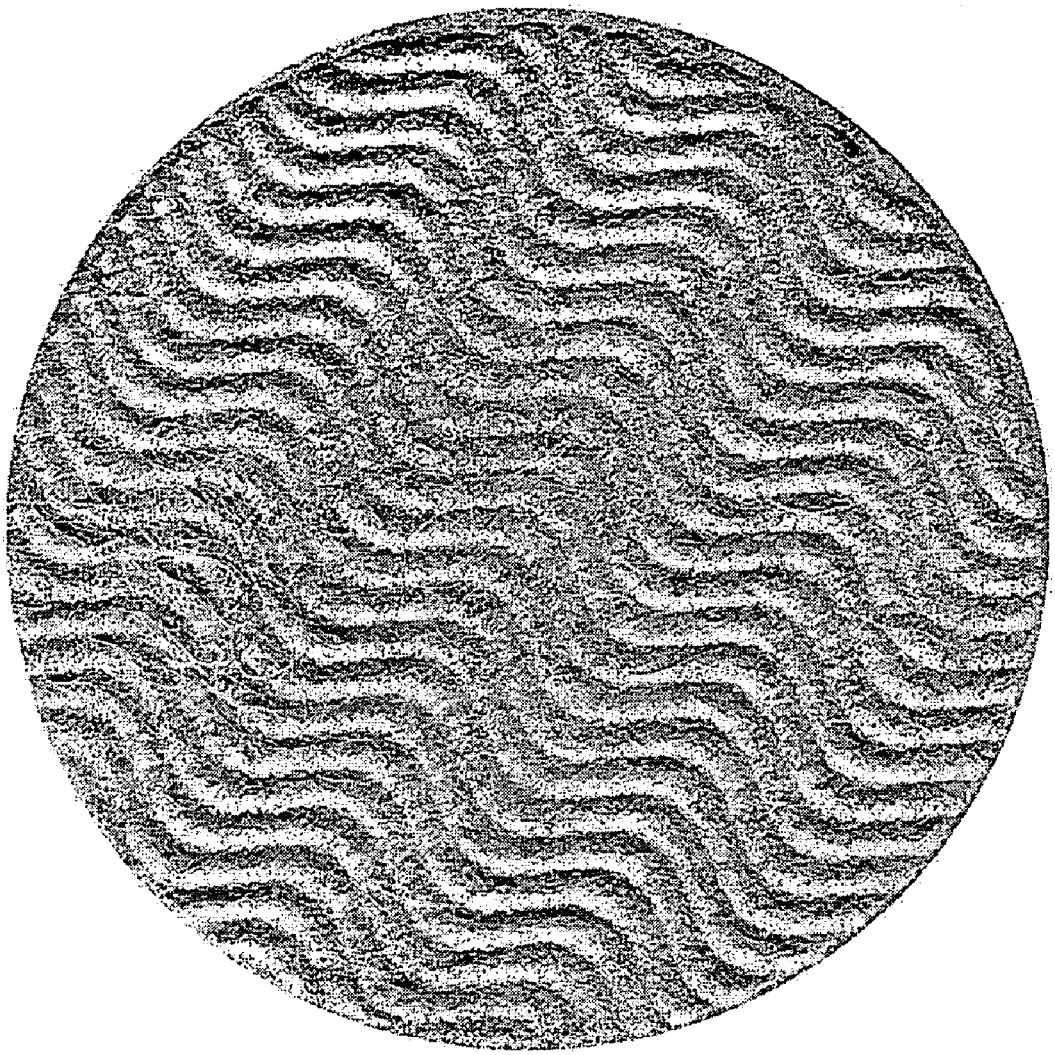
FIG. 17 is a photograph of a two-ply non-woven tissue making fabric molded against the three-dimensional plate of FIG. 14.
Figure 18:
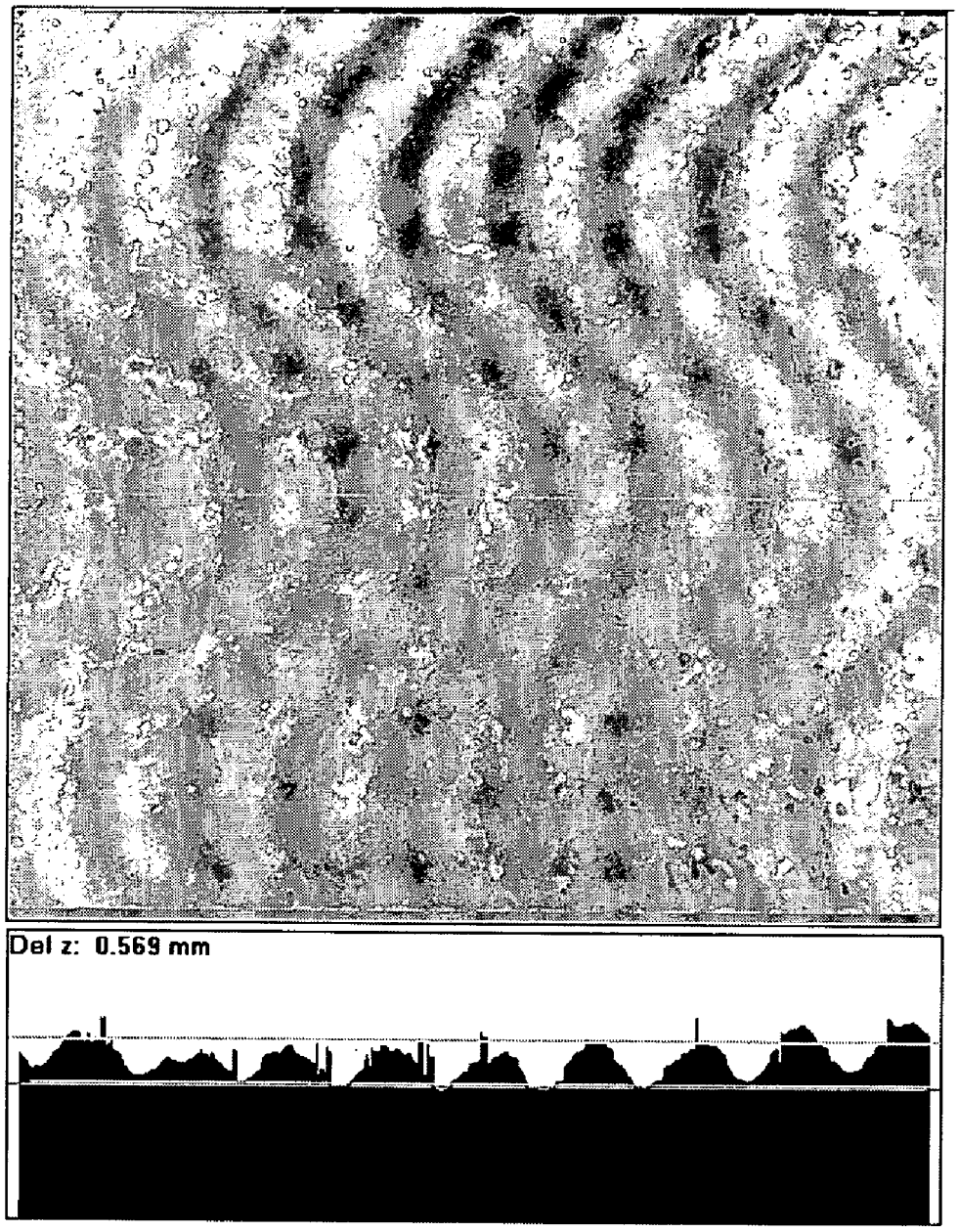
FIG. 18 is a screen shot showing a topographic height map of a portion of the non-woven tissue making fabric of FIG. 17.

FIG. 17 is a photograph of the two-ply non-woven tissue making fabric molded against the first three-dimensional plate. FIG. 18 is a height map of a portion of the non-woven tissue making fabric, showing a characteristic peak-to-valley height of about 0.57 mm, somewhat less than the peak-to-valley height of the metal plate.

Prophetic Example:

A non-woven tissue making fabric may be made from non-woven materials comprising elastomeric components or mechanically configured to be stretchable in the cross-direction, such as neck-bonded nonwoven laminates, such that the non-woven tissue making fabric is extensible in the cross-direction. In one embodiment, the non-woven tissue making fabric is elastically stretchable in the cross-direction but relatively non-stretchable (no more than is customary for conventional woven papermaking fabrics) in the machine direction. A cross-direction stretchable non-woven tissue making fabric may be stretched as embryonic tissue web is formed thereon or prior to placing an embryonic tissue web thereon. The cross-direction-stretched non-woven tissue making fabric may then be relaxed to create cross-directional foreshortening in the tissue web. Contraction of the tissue web may be done as the non-woven tissue making fabric passes over a vacuum box or during through drying, such that differential air pressure helps hold the tissue web in contact with the non-woven tissue making fabric to prevent buckling or separation of the tissue web during contraction. The cross-directional foreshortening of the tissue web in this manner may impart high levels of cross-directional stretch (e.g., equal to or greater than about 9%, about 12%, or about 15%) in the tissue web, and may impart interesting and useful texture to the tissue web.

It will be appreciated that the foregoing examples and description, given for purposes of illustration, are not to be construed as limiting the scope of the present invention, which is defined by the following claims and all equivalents thereto.

We claim:

1. A method of making an endless non-woven tissue making fabric having a three-dimensional texture suitable for use as a fabric for producing three-dimensional fibrous webs comprising:

a. providing an endless non-woven tissue making fabric having a tissue contacting surface and a tissue machine contacting surface;

b. passing heated air through a molding device;

c. passing the endless non-woven tissue making fabric through a nip formed between a surface of a gas pervious roll and a surface of the molding device, wherein the surface of the molding device includes a textured molding surface; and, d. conforming at least a portion of the endless non-woven tissue making fabric to the textured molding surface of the molding device, thereby forming a three-dimensional texture on the endless non-woven tissue making fabric.

2. The method of claim 1, wherein the molding device further comprises a suction roll.

3. The method of claim 2, wherein the suction roll provides a zone of vacuum.

4. The method of claim 1, further comprising providing a cooling device to cool the endless non-woven tissue making fabric.

5. The method of claim 1, wherein the molding device comprises raised molding elements.

6. The method of claim 1, wherein the molding device comprises molding elements having a shape selected from the group consisting of: sine wave-shaped; triangle-shaped; square wave-shaped; irregular-shaped; and, any combination thereof.

7. The method of claim 1, wherein the heated air is provided by an air knife.

8. The method of claim 1, wherein the molding device comprises porous molding elements.

9. The method of claim 8, wherein the molding elements are comprised of material selected from the group consisting of sintered metal; finely drilled metal; finely drilled plastic; sintered ceramic; ceramic foam; and, any combination thereof.

10. The method of claim 1, further comprising contacting the tissue contacting surface of the endless non-woven tissue making fabric with the surface of the molding device.

11. The method of claim 10, wherein at least a portion of the tissue contacting surface of the endless non-woven tissue making fabric conforms with the surface of the molding device.

12. The method of claim 1, further comprising contacting the tissue machine contacting surface of the endless non-woven tissue making fabric with the surface of the molding device.

13. The method of claim 1, wherein the three-dimensional texture comprises a repeating pattern.

14. The method of claim 13, wherein the repeating pattern includes a series of raised elements and depressed elements defining a repeating unit cell.

15. The method of claim 14, wherein the repeating unit cell of the repeating pattern includes a width of about 3 mm or greater in the cross-machine direction of the endless non-woven tissue making fabric.

16. The method of claim 14, wherein the repeating unit cell of the repeating pattern includes a length of about 3 mm or greater in the machine direction of the endless non-woven tissue making fabric.

17. The method of claim 14, wherein the repeating unit cell of the repeating pattern includes a percentage value in the machine direction length of the endless non-woven making fabric of about 1% or greater.

18. The method of claim 1, wherein the tissue contacting surface of the endless non-woven tissue making fabric is differently textured than the tissue machine contacting surface of the endless non-woven tissue making fabric.

19. The method of claim 1, wherein the tissue contacting surface of the endless non-woven tissue making fabric is substantially textured the same as the tissue machine contacting surface of the endless non-woven tissue making fabric.

20. The method of claim 15, wherein the endless non-woven tissue making fabric comprises multi-component binder materials.

21. The method of claim 20, wherein the multi-component binder material includes at least a first portion and a second portion, wherein the first portion has a lower melting point that the second portion.

22. The method of claim 20, wherein the multi-component binder material is selected from the group consisting of: bi-component concentric sheath-core; bi-component asymmetric sheath-core; bi-component side-by-side; and, any combination thereof.

23. The method of claim 1, wherein the endless non-woven tissue making fabric is formed on a carrier fabric.

24. The method of claim 23, wherein the endless non-woven tissue making fabric is attached to the carrier fabric.

25. The method of claim 20, wherein the endless non-woven tissue making fabric is comprised of fibers or filaments selected from the group consisting of: spun bond fibers; melt blown fibers; and, combinations thereof.

26. The method of claim 1, wherein the surface of the gas pervious roll includes molding elements.

27. The method of claim 26, wherein the surface of the gas pervious roll including the molding elements is a textured sleeve.

28. The method of claim 26, wherein the molding elements of the gas pervious roll are raised elements.

29. The method of claim 28, wherein the surface of the gas pervious roll including the raised elements is a textured sleeve.

30. The method of claim 26, wherein the molding elements of the gas pervious roll mesh with raised molding elements of the molding device.

31. The method of claim 1, wherein the tissue contacting surface of the endless non-woven tissue making fabric includes a three-dimensional texture and the tissue machine contacting surface of the endless non-woven tissue making fabric includes a three-dimensional texture.

32. The method of claim 26, wherein the tissue contacting surface of the endless non-woven tissue making fabric includes a three-dimensional texture and the tissue machine contacting surface of the endless non-woven tissue making fabric includes a three-dimensional texture.

33. The method of claim 1, wherein the non-woven tissue making fabric does not comprise a woven element.

* * * * *